US009494285B2

(12) United States Patent
Maglica

(10) Patent No.: US 9,494,285 B2
(45) Date of Patent: Nov. 15, 2016

(54) LIGHTING DEVICES

(71) Applicant: Mag Instrument, Inc., Ontario (CA)

(72) Inventor: Anthony Maglica, Ontario (CA)

(73) Assignee: MAG INSTRUMENT, INC, Ontario (CA)

( * ) Notice: Subject to any disclaimer, the term of this patent is extended or adjusted under 35 U.S.C. 154(b) by 0 days.

(21) Appl. No.: 15/015,009

(22) Filed: Feb. 3, 2016

(65) Prior Publication Data

US 2016/0153625 A1 Jun. 2, 2016

Related U.S. Application Data

(63) Continuation-in-part of application No. 14/153,970, filed on Jan. 13, 2014, now Pat. No. 9,255,696, and a continuation-in-part of application No. 14/971,971, filed on Dec. 16, 2015, and a continuation-in-part of application No. 14/869,628, filed on Sep. 29, 2015, and a continuation-in-part of application No. 14/869,962, filed on Sep. 29, 2015.

(60) Provisional application No. 61/751,935, filed on Jan. 13, 2013, provisional application No. 61/791,905, filed on Mar. 15, 2013, provisional application No. 61/839,362, filed on Jun. 25, 2013, provisional application No. 61/858,818, filed on Jul. 26, 2013, provisional application No. 62/095,733, filed on Dec. 22, 2014.

(51) Int. Cl.

| | |
|---|---|
| ***F21L 4/00*** | (2006.01) |
| ***F21L 4/04*** | (2006.01) |
| ***F21V 29/503*** | (2015.01) |
| ***F21V 29/70*** | (2015.01) |
| ***F21V 23/04*** | (2006.01) |
| ***F21V 14/04*** | (2006.01) |
| *F21Y 101/02* | (2006.01) |

(52) U.S. Cl.

CPC ..... *F21L 4/045* (2013.01); *F21V 14/045* (2013.01); *F21V 23/0414* (2013.01); *F21V 29/503* (2015.01); *F21V 29/70* (2015.01); *F21L 4/005* (2013.01); *F21Y 2101/02* (2013.01)

(58) Field of Classification Search

CPC ..... F21L 14/04; F21L 15/00; F21L 15/06; F21V 14/05; F21V 23/0414; F21V 29/70; F21V 29/503

USPC ..... 362/157, 188, 208

See application file for complete search history.

(56) References Cited

U.S. PATENT DOCUMENTS

| | | | |
|---|---|---|---|
| 4,286,311 | A | 8/1981 | Maglica |
| 6,666,565 | B2 | 12/2003 | Gabe |

(Continued)

OTHER PUBLICATIONS

PCT/US2015/066201, Nov. 3, 2015, Int'l Search Report.

*Primary Examiner* — Anabel Ton

(74) *Attorney, Agent, or Firm* — Roy L Anderson

(57) ABSTRACT

A flashlight having a LED directly mounted to a top surface of a heat sink without the use of a printed circuit board and two mechanical spiral engagement systems, one in the housing, the other in a head assembly, such that the LED is turned on when power from an electrical circuit is applied to the heatsink which is thermally connected to a first electrically conductive member of the LED and a second electrically conductive member of the LED which is insulated within the heatsink from the heatsink, and the light provided by the LED may be varied by rotating the head assembly relative to the housing while the heat sink, the switch assembly and the power source remain stationary.

5 Claims, 45 Drawing Sheets

(56) References Cited

U.S. PATENT DOCUMENTS

| | | | | |
|---|---|---|---|---|
| 6,685,336 | B1 | 2/2004 | Neiser | |
| 6,799,864 | B2 | 10/2004 | Bohler et al. | |
| 6,827,468 | B2 | 12/2004 | Galli | |
| 6,942,358 | B2 | 9/2005 | Neiser | |
| 6,942,365 | B2 | 9/2005 | Galli | |
| 6,966,677 | B2 | 11/2005 | Galli | |
| 6,974,234 | B2 | 12/2005 | Galli | |
| 7,055,989 | B2 | 6/2006 | Galli | |
| 7,083,305 | B2 | 8/2006 | Galli | |
| 7,093,954 | B2 * | 8/2006 | Sharrah | F21L 4/027 362/202 |
| 7,118,255 | B2 | 10/2006 | Galli | |
| 7,121,680 | B2 | 10/2006 | Galli | |
| 7,153,004 | B2 | 12/2006 | Galli | |
| 7,188,978 | B2 | 3/2007 | Sharrah et al. | |
| 7,201,492 | B2 | 4/2007 | Galli | |
| 7,214,952 | B2 | 5/2007 | Klipstein et al. | |
| 7,321,161 | B2 | 1/2008 | Teixeira et al. | |
| 7,490,951 | B2 | 2/2009 | Klipstein et al. | |
| 7,614,760 | B2 | 11/2009 | Sharrah et al. | |
| 7,652,303 | B2 | 1/2010 | Galli | |
| 7,686,469 | B2 | 3/2010 | Rudd et al. | |
| 7,771,087 | B2 | 8/2010 | Wilcox et al. | |
| 7,798,667 | B2 | 9/2010 | Klipstein | |
| 7,808,013 | B2 | 10/2010 | Mendendorp et al. | |
| 7,850,345 | B2 | 12/2010 | Holder et al. | |
| 7,950,818 | B2 | 5/2011 | Klipstein et al. | |
| 8,093,620 | B2 | 1/2012 | Galli | |
| 8,152,327 | B2 | 4/2012 | Brands et al. | |
| 8,226,267 | B2 | 7/2012 | Sharrah et al. | |
| 8,371,729 | B2 | 2/2013 | Sharrah et al. | |
| 8,376,577 | B2 | 2/2013 | Harbers et al. | |
| 8,388,167 | B2 | 3/2013 | Klipstein et al. | |
| 8,425,071 | B2 | 4/2013 | Rudd et al. | |
| 8,733,966 | B2 | 5/2014 | Maglica | |
| 2005/0017366 | A1 | 1/2005 | Galli | |
| 2005/0243544 | A1 | 11/2005 | Neiser | |
| 2007/0109775 | A1 | 5/2007 | Chen | |
| 2007/0117273 | A1 | 5/2007 | Elpedes et al. | |
| 2009/0218586 | A1 | 9/2009 | Cho et al. | |
| 2010/0033972 | A1 | 2/2010 | Maglica | |
| 2010/0219775 | A1 | 9/2010 | Maglica | |
| 2011/0012535 | A1 | 1/2011 | West et al. | |
| 2011/0111536 | A1 | 5/2011 | Bruner | |
| 2011/0227500 | A1 | 9/2011 | West et al. | |
| 2012/0020104 | A1 | 1/2012 | Biebl et al. | |
| 2012/0170262 | A1 | 7/2012 | Hoetzl et al. | |
| 2013/0049582 | A1 | 2/2013 | West et al. | |
| 2013/0070452 | A1 | 3/2013 | Urano et al. | |
| 2013/0082600 | A1 | 4/2013 | Ter-Hovhanissian et al. | |
| 2013/0099275 | A1 | 4/2013 | Pi | |
| 2013/0135860 | A1 | 5/2013 | Harbers et al. | |
| 2013/0148367 | A1 | 6/2013 | Sharrah et al. | |
| 2013/0271983 | A1 | 10/2013 | Leshniak et al. | |
| 2014/0049961 | A1 | 2/2014 | Wilcox et al. | |
| 2014/0104835 | A1 | 4/2014 | Rudd et al. | |
| 2014/0211470 | A1 | 7/2014 | Kinnune et al. | |
| 2014/0218902 | A1 | 8/2014 | Maglica | |
| 2014/0218941 | A1 | 8/2014 | Wilcox et al. | |
| 2014/0226339 | A1 | 8/2014 | Kinnune et al. | |
| 2014/0247590 | A1 | 9/2014 | Wilcox | |
| 2014/0347846 | A1 | 11/2014 | Ahn et al. | |
| 2015/0043211 | A1 | 2/2015 | Liu et al. | |

* cited by examiner

SECTION A–A
SCALE 2X

LIGHTING DEVICES

CROSS-REFERENCE TO RELATED APPLICATIONS

This application is a continuation-in-part application of U.S. Ser. No. 14/153,970, filed Jan. 13, 2014, which itself claimed the benefit of U.S. Provisional Application Ser. Nos. 61/751,935, filed Jan. 13, 2013, 61/791,905, filed Mar. 15, 2013, 61/839,362, filed Jun. 25, 2013 and 61/858,818, filed Jul. 26, 2013, the contents of all of which are specifically incorporated by reference as if fully set forth herein.

This application is also a continuation-in-part application of U.S. Ser. No. 14/971,971, filed Dec. 16, 2015, which itself claimed the benefit of U.S. Provisional Application Ser. No. 62/095,733, filed Dec. 22, 2014, the contents of all of which are specifically incorporated by reference as if fully set forth herein.

This application is also a continuation-in-part application of U.S. Ser. Nos. 14/869,628 and 14/869,962, filed Sep. 29, 2015, the contents of both of which are specifically incorporated by reference as if fully set forth herein.

FIELD OF THE INVENTION

The field of the invention relates to lighting devices, such as flashlights, that reflect simplified designs having fewer component parts, and that may include innovative focusing and reflector features, components that serve multiple functions, electronics and/or electronics packaging.

BACKGROUND OF THE INVENTION

Existing lighting devices, such as flashlights, typically involve a number of component parts. As the number of component parts increases, manufacturing costs may also increase and durability may decrease. That is, as the number of components increase, the cost to assemble them generally increases as does the chance that one or more component parts may later fail.

Accordingly, it would be beneficial for a flashlight design to have a reduced number of component parts. It would also be beneficial to simplify the manner in which the components interact. It would also be beneficial to generally simplify the design which may make the flashlight easier to manufacture and at lower cost, and may also make it easier for the user to operate the flashlight and increase its durability.

Various existing lighting devices, such as flashlights, provide a focusing feature where the beam of light may be varied between spot and flood and vice versa. This may occur through the collimation of light by relative motion of the light source and reflector. Certain existing focusing features move the light source relative to the reflector. However, this may require a number of component parts that may increase component and manufacturing costs. Accordingly, it would be advantageous to provide an alternative focusing feature that may involve fewer component parts.

Many, if not most, current lighting devices use a reflector to direct the beam of light. However, the configuration of the reflector and the manufacturing process used to produce it may sometimes result in distortion to the reflector surface. Accordingly, it would be advantageous for the reflector to have a design that avoids distortion when it is manufactured.

Various existing lighting devices now include electronics that may provide different functions. Oftentimes, these electronics may be located in a certain location within the lighting device. However, the location of these electronics may affect what functions may be offered and/or how the electronics may operate. And in smaller lighting devices such as flashlights, there is generally a limited volume of space where electronics may be located. Accordingly, it would be advantageous to locate electronics and package them so as to increase their utility and lower cost.

Over recent years, flashlights and other lighting devices have been able to operate in different modes of operation. For example, certain current flashlights now provide different modes such as a standard brightness beam, a brighter or dimmer beam, a blinking beam and/or other modes. However, the manner in which different modes may be selected by the user may be cumbersome. Accordingly, it would be advantageous to provide an improved and efficient manner in which the user may select different modes.

It is generally desired for lighting devices to provide brighter beams of light and/or a larger spot. Accordingly, it would be advantageous to use larger and/or more powerful light sources.

The current invention addresses the foregoing issues as well as other issues as described herein.

SUMMARY OF THE INVENTION

The present invention is generally directed to a flashlight having a LED directly mounted to a top surface of a heat sink without the use of a printed circuit board and two mechanical spiral engagement systems, one in the housing, the other in a head assembly, such that the LED is turned on when power from an electrical circuit is applied to the heatsink which is thermally connected to a first electrically conductive member of the LED and a second electrically conductive member of the LED which is insulated within the heatsink from the heatsink, and the light provided by the LED may be varied by rotating the head assembly relative to the housing while the heat sink, the switch assembly and the power source remain stationary.

Accordingly, it is a primary object of the present invention to provide and improved flashlight.

This and further objects and advantages of the present invention will be apparent to those skilled in the art in connection with the drawings and the detailed description of the invention set forth below.

BRIEF DESCRIPTION OF THE DRAWINGS

1. Tube or barrel
2. Heatsink
3. Insulator
4. Terminal to connect power to LED
5. LED
6. Thermal junction and first electrical connection between LED and heatsink
7. Second electrical connection FIG. 21B is a cross sectional view which is shown exploded in FIG. 21D while FIGS. 21A and 21C are, respectively, top and bottom views looking into the apparatus shown in cross section in FIG. 21B.

1. Tube or barrel
2. Heatsink
3. Insulator
4. Terminal to connect power to LED
5. LED
6. Thermal junction and first electrical connection between LED and heatsink
7. Second electrical connection FIG. 22B is a cross sectional view which is shown exploded in FIG. 22D while FIGS. 22A and 22C are, respectively, top and bottom views looking into the apparatus shown in cross section in FIG. 22B.

1. Integral tube or barrel and heatsink
3. Insulator
4. Terminal to connect power to LED
5. LED
6. Thermal junction and first electrical connection between LED and heatsink
7. Second electrical connection FIG. 23B is a cross sectional view which is shown exploded in FIG. 23D while FIGS. 23A and 23C are, respectively, top and bottom views looking into the apparatus shown in cross section in FIG. 23B.

1. Tube or barrel
2. Heatsink
3. Insulator
4. Terminal to connect power to LED
5. LED
6. Thermal junction and first electrical connection between LED and heatsink
7. Second electrical connection
8. Printed circuit board
9. Insulator
10. Contact FIG. 24B is a cross sectional view which is shown exploded in FIG. 24D while FIGS. 24A and 24C are, respectively, top and bottom views looking into the apparatus shown in cross section in FIG. 24B.

1. Tube or barrel
2. Heatsink
3. Insulator
4. Terminal to connect power to LED
5. LED
6. Thermal junction and first electrical connection between LED and heatsink
7. Second electrical connection
8. Printed circuit board
9. Insulator
10. Contact FIG. 25B is a cross sectional view which is shown exploded in FIG. 25D while FIGS. 25A and 25C are, respectively, top and bottom views looking into the apparatus shown in cross section in FIG. 25B.

1. Integral tube or barrel and heatsink
3. Insulator
4. Terminal to connect power to LED
5. LED
6. Thermal junction and first electrical connection between LED and heatsink
7. Second electrical connection
8. Printed circuit board
9. Insulator
10. Contact FIG. 26B is a cross sectional view which is shown exploded in FIG. 26D while FIGS. 26A and 26C are, respectively, top and bottom views looking into the apparatus shown in cross section in FIG. 26B.

FIGS. 27A-D have the following identified elements:

1. Tube or barrel
2. Heatsink
3. Insulator
4. Terminal to connect power to LED
5. LED 6. Thermal junction and first electrical connection between LED and heatsink 7. Second electrical connection FIG. 27B is a cross sectional view which is shown exploded in FIG. 27D while FIGS. 27A and 27C are, respectively, top and bottom views looking into the apparatus shown in cross section in FIG. 27B.

FIGS. 28A-D have the following identified elements:

1. Tube or barrel

2. Heatsink

3. Insulator

4. Terminal to connect power to LED

5. LED

6. Thermal junction and first electrical connection between LED and heatsink

7. Second electrical connection

8. Printed circuit board

9. Insulator

10. Contact

Figure 28D:
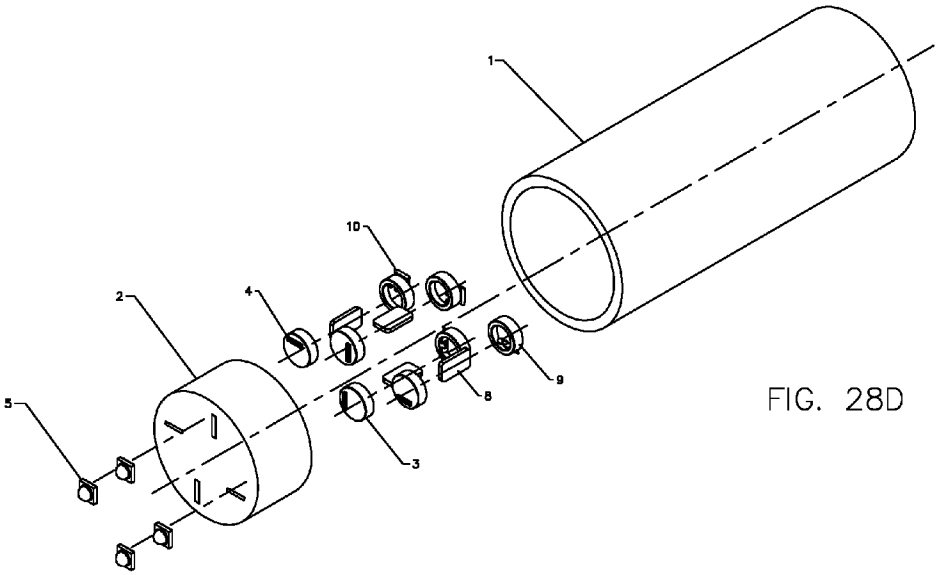
FIGS. 28A-D show a circular array of LEDs mounted to a common heatsink with printed circuit boards in the insulating member. Four LEDs are shown here but there could be any number of LEDs.
Figure 28B:
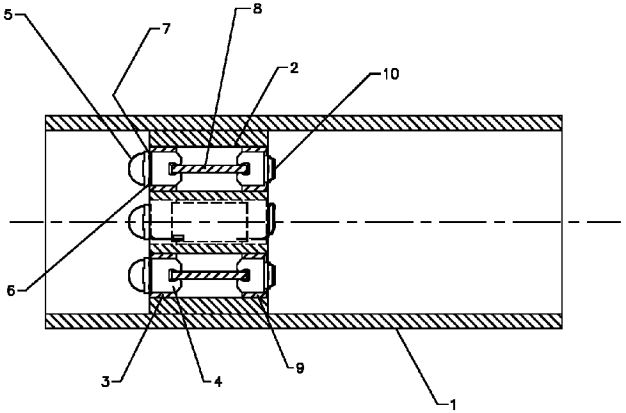
Figure 28C:
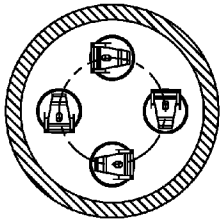
Figure 28A:
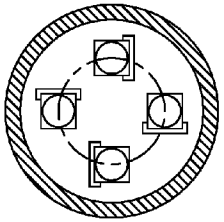

FIG. 28B is a cross sectional view which is shown exploded in FIG. 28D while FIGS. 28A and 28C are, respectively, top and bottom views looking into the apparatus shown in cross section in FIG. 28B.

Figure 29C:
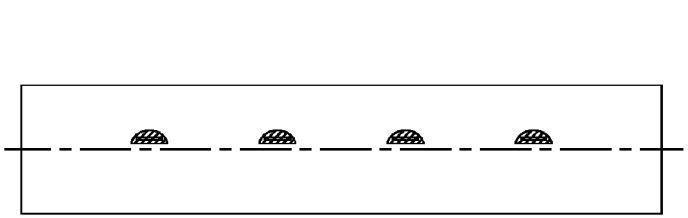
Figure 29B:
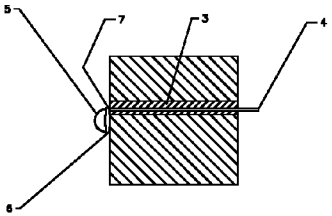
Figure 29A:
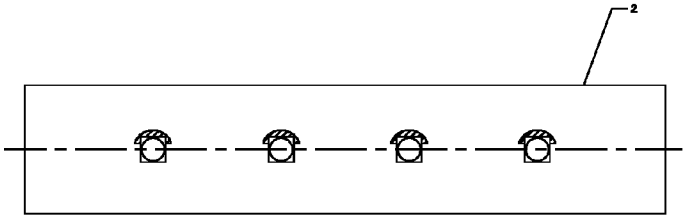

FIGS. 29A-C show a linear array of LEDs on a common heatsink. Four LEDs are shown here but there could be any number of LEDs. FIGS. 29A-C have the following identified elements:

2. Heatsink

3. Insulator

4. Terminal to connect power to LED

5. LED

6. Thermal junction and first electrical connection between LED and heatsink

7. Second electrical connection

FIG. 29B is a cross sectional view of a single LED and FIGS. 29A and 29C are, respectively, top and bottom views of a linear array of four LEDs.

Figure 30C:
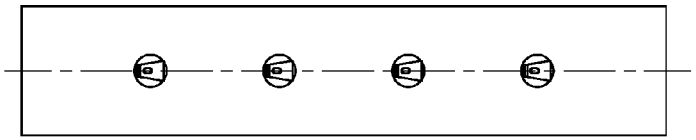
Figure 30B:
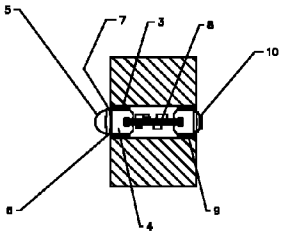
Figure 30A:
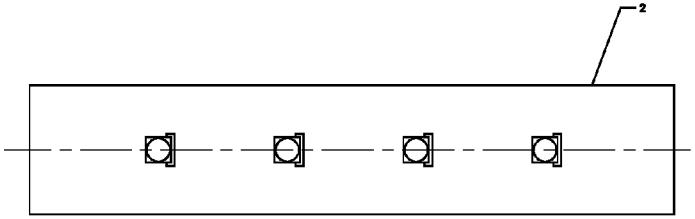

FIGS. 30A-C show a linear array of LEDs similar to those on FIGS. 29A and 29C but containing printed circuit boards. Four LEDs are shown here but there could be any number of LEDs. FIGS. 30A-C have the following identified elements:

2. Heatsink

3. Insulator

4. Terminal to connect power to LED

5. LED

6. Thermal junction and first electrical connection between LED and heatsink

7. Second electrical connection

8. Printed circuit board

9. Insulator

10. Contact

FIG. 30B is a cross sectional view of a single LED and FIGS. 30A and 30C are, respectively, top and bottom views of a linear array of four LEDs.

Figure 21D:
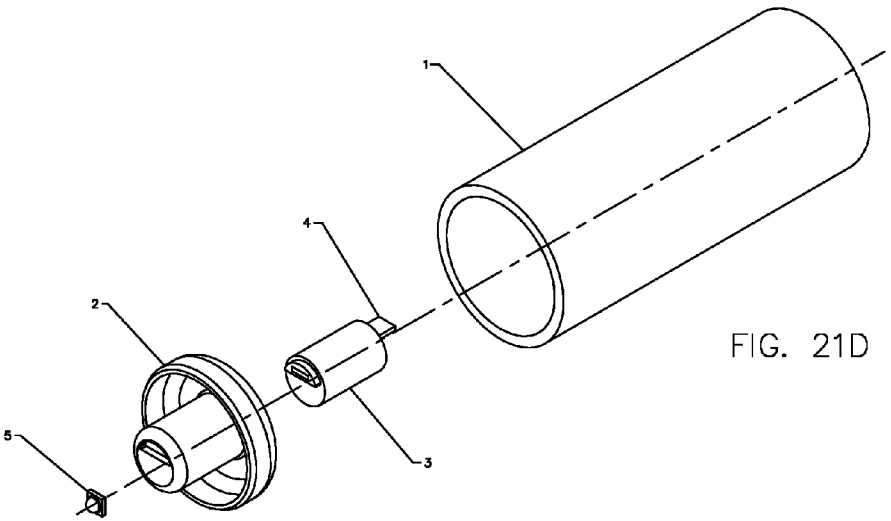
FIGS. 21A-D show a heatsink and insulating core installed in a metal tube or flashlight barrel having the following identified elements.
Figure 21B:
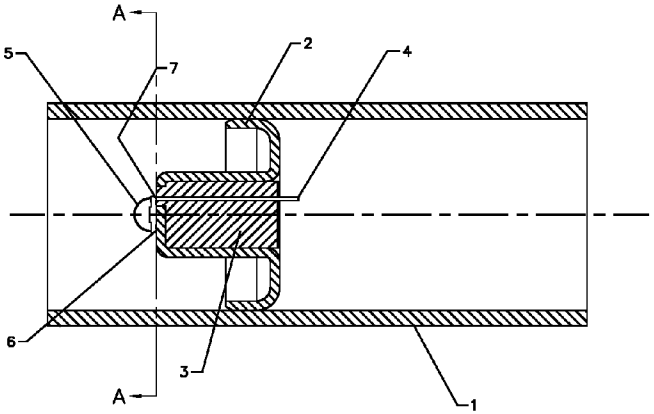
Figure 21C:
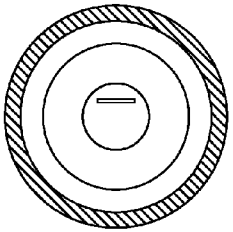
Figure 21A:
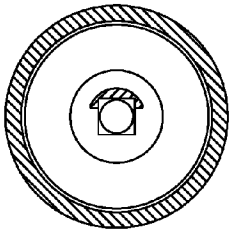
Figure 22D:
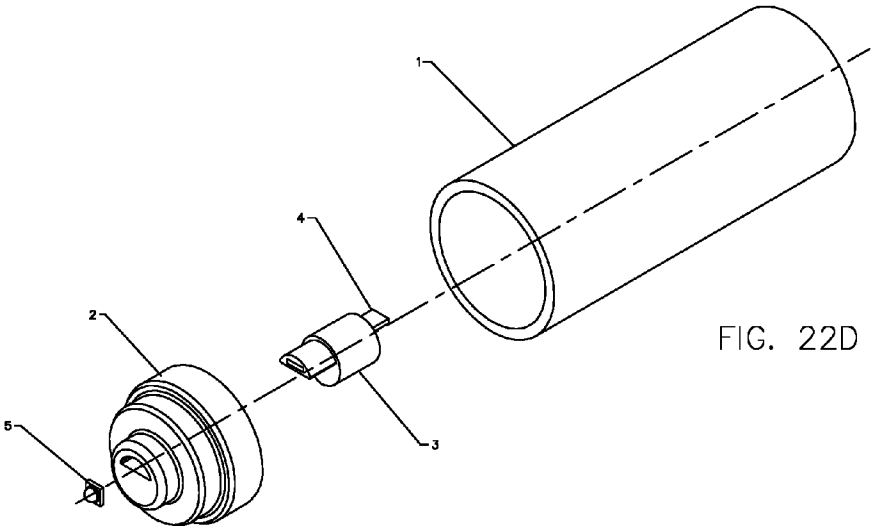
FIGS. 22A-D show a variation on FIGS. 21A-D in which the heatsink and insulating core are installed in a metal tube or flashlight barrel having the following identified elements.
Figure 22C:
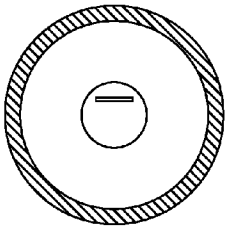
Figure 22B:
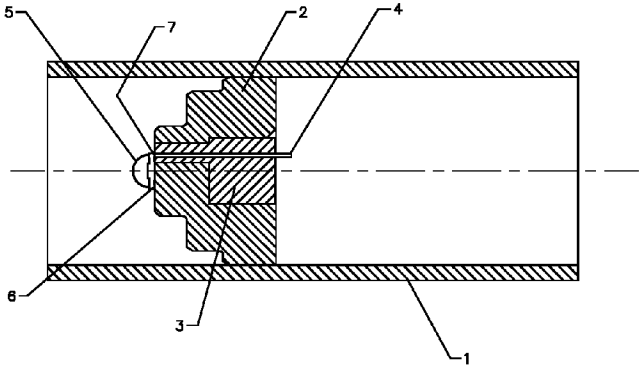
Figure 22A:
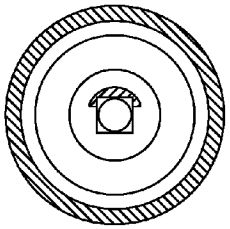
Figure 23C:
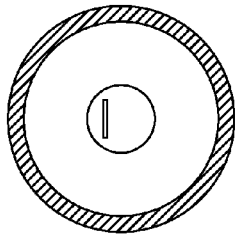
FIGS. 23A-D show a one-piece heatsink similar to that shown in FIGS. 22A-D having the following identified elements.
Figure 23B:
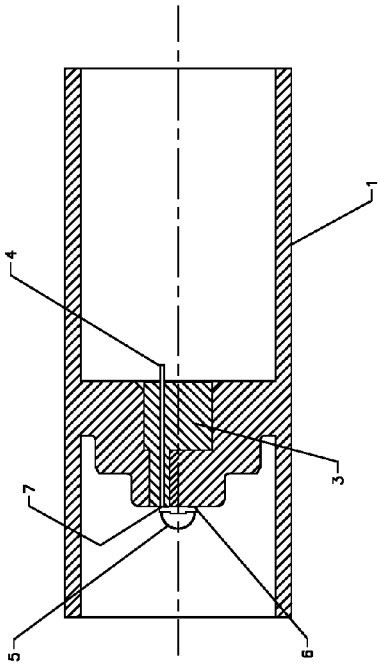
Figure 23D:
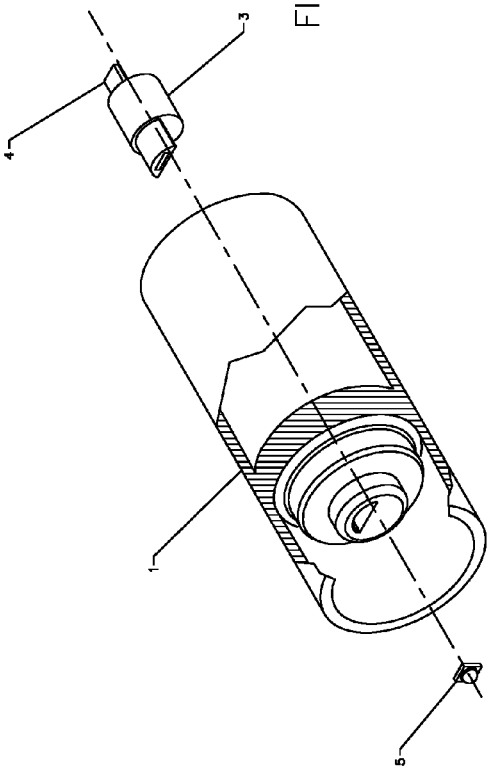
Figure 23A:
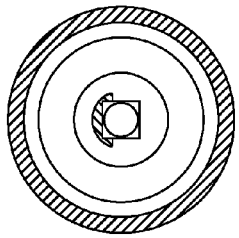
Figure 24D:
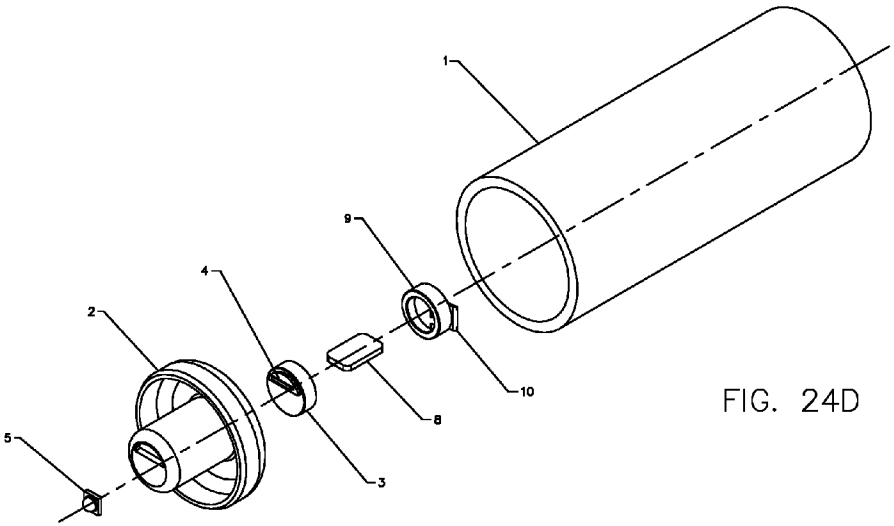
FIGS. 24A-D show a variation on the heatsink and insulating core in FIGS. 21A-D. In this example, there is a printed circuit board between the LED and the other end of the assembly having the following identified elements.
Figure 24C:
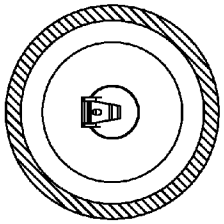
Figure 24B:
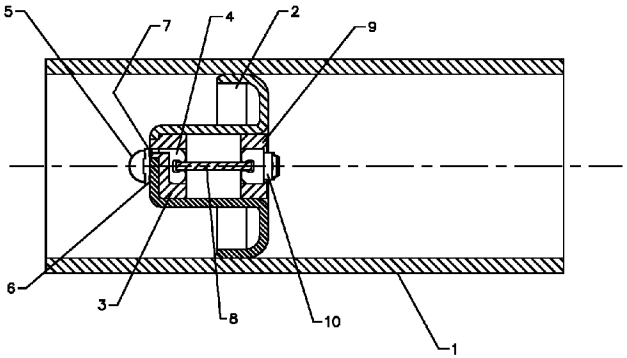
Figure 24A:
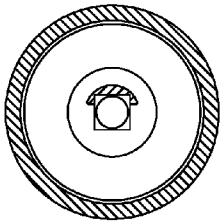
Figure 25D:
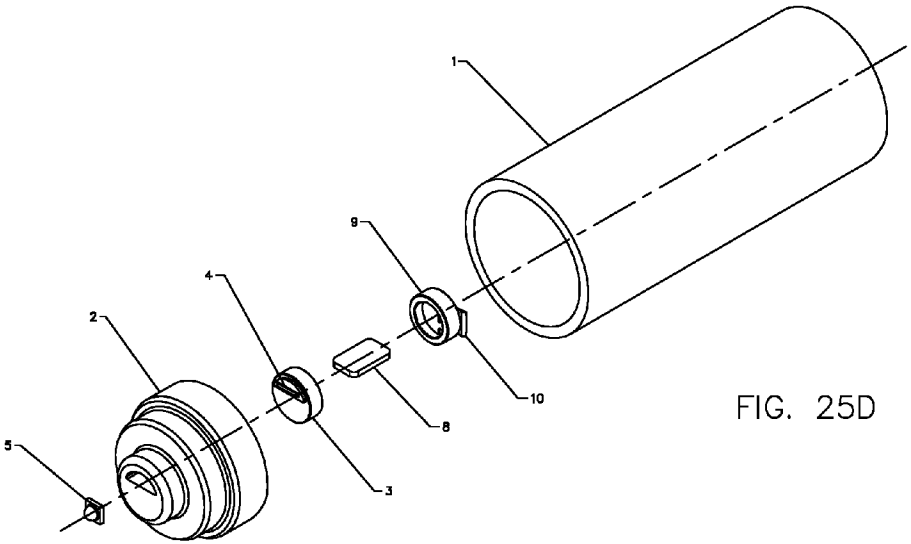
FIGS. 25A-D show a variation of the assembly shown in FIGS. 24A-D having the following identified elements.
Figure 25B:
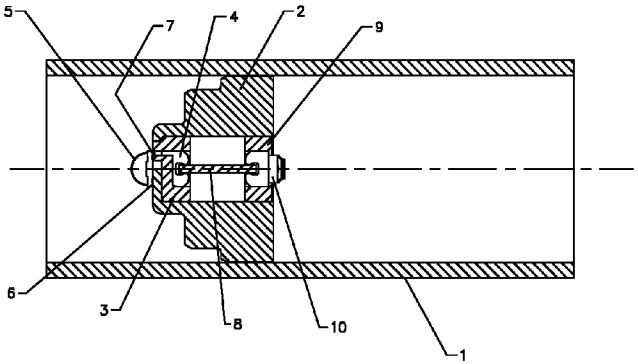
Figure 25C:
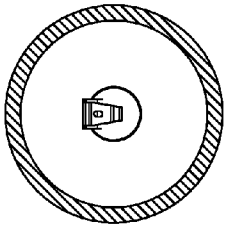
Figure 25A:
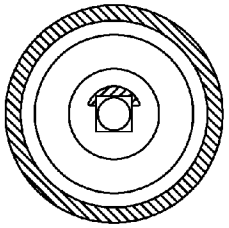
Figure 26D:
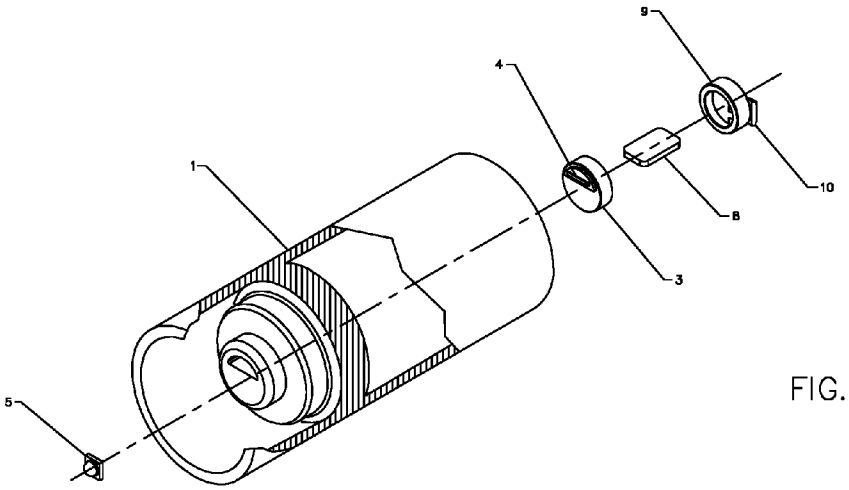
FIGS. 26A-D show a heatsink similar to that in FIGS. 23A-D but containing a printed circuit board having the following identified elements.
Figure 26B:
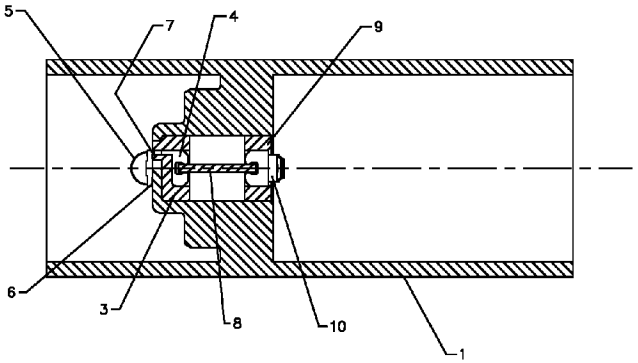
Figure 26C:
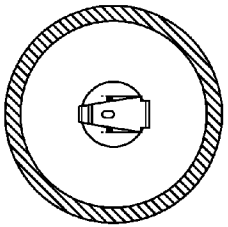
Figure 26A:
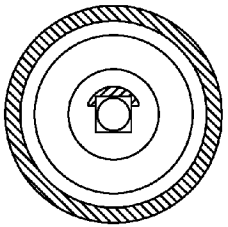
Figure 27D:
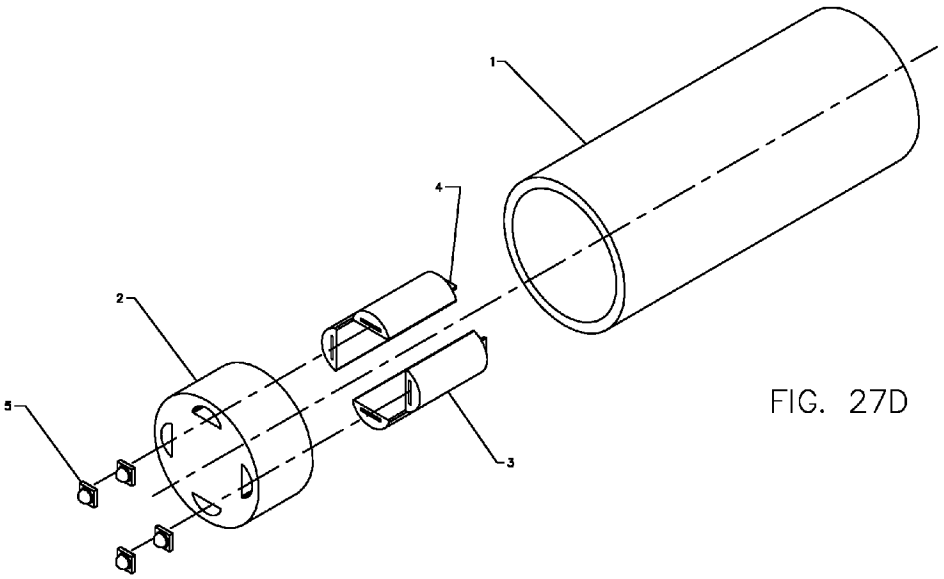
FIGS. 27A-D show a circular array of LEDs mounted on a common heatsink. Four LEDs are shown here but there could be any number of LEDs.
Figure 27B:
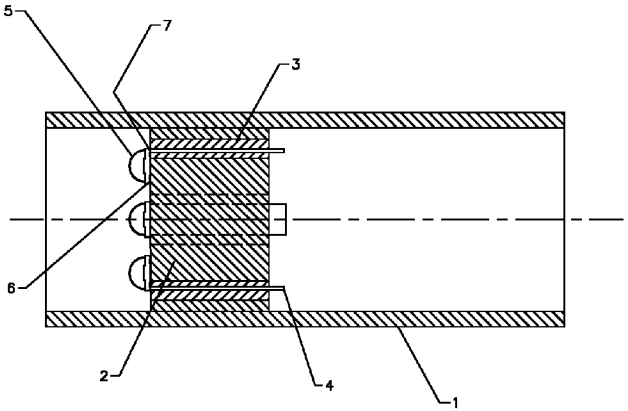
Figure 27C:
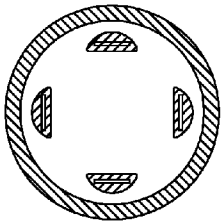
Figure 27A:
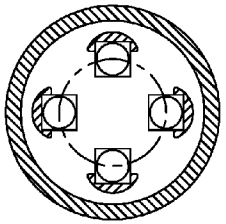
Figure 31:
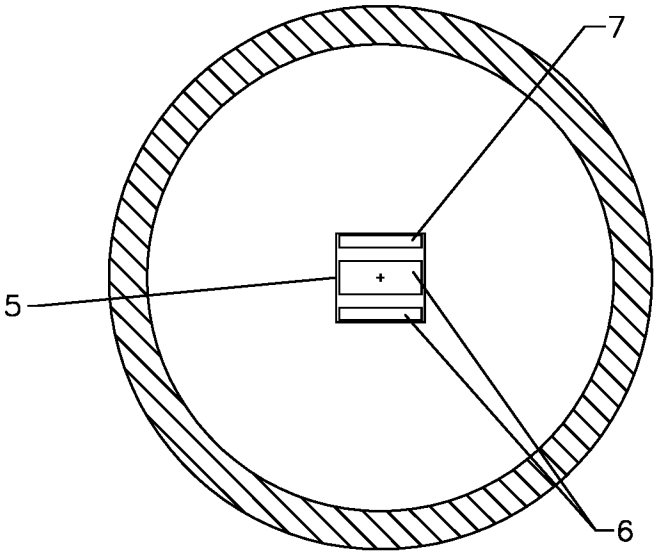

FIG. 31 is a cross sectional magnified view from FIG. 21B which shows the top of heatsink 5 without the LED in place having the following identified elements:

6. Thermal junction and first electrical connection between LED and heatsink

7. Second electrical connection

FIGS. 32A-E show a typical prior art LED assembly showing the LED soldered to a PC board and the multiple thermal junctions required to conduct heat to ambient air having the following identified elements:

101. Tube or barrel

102. Heatsink

103. Insulator

104. Contact for applying power to printed circuit board

105. LED

106. Housing

107. Insulator

108. Contact for connecting printed circuit board 111 to PCB 109

109. Multilayered printed circuit board

110. Ring Contact

111. Printed circuit board

Figure 32C:
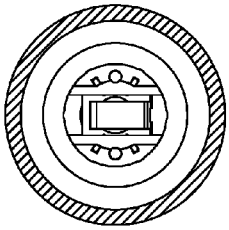
Figure 32B:
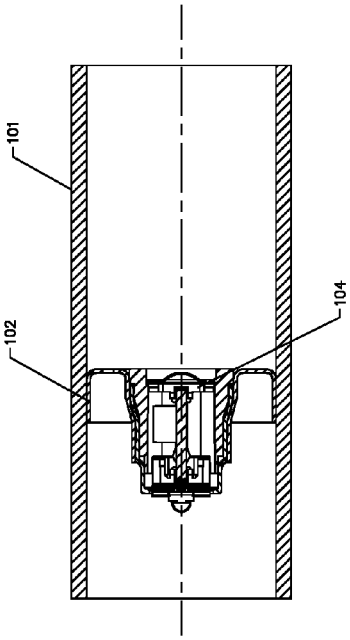
FIG. 32B PRIOR ART
Figure 32A:
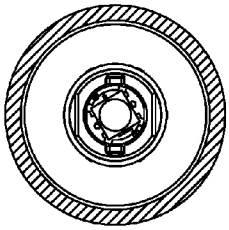
Figure 32D:
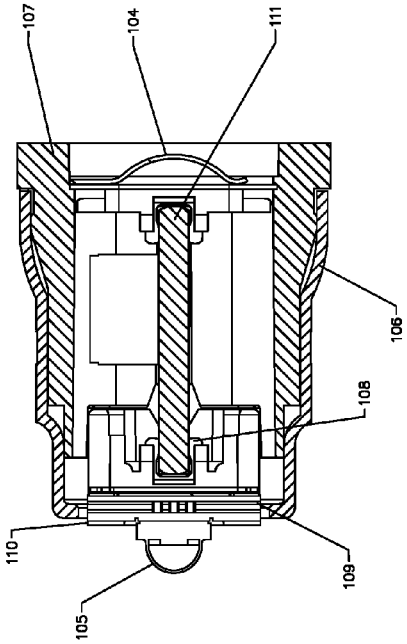
Figure 32E:
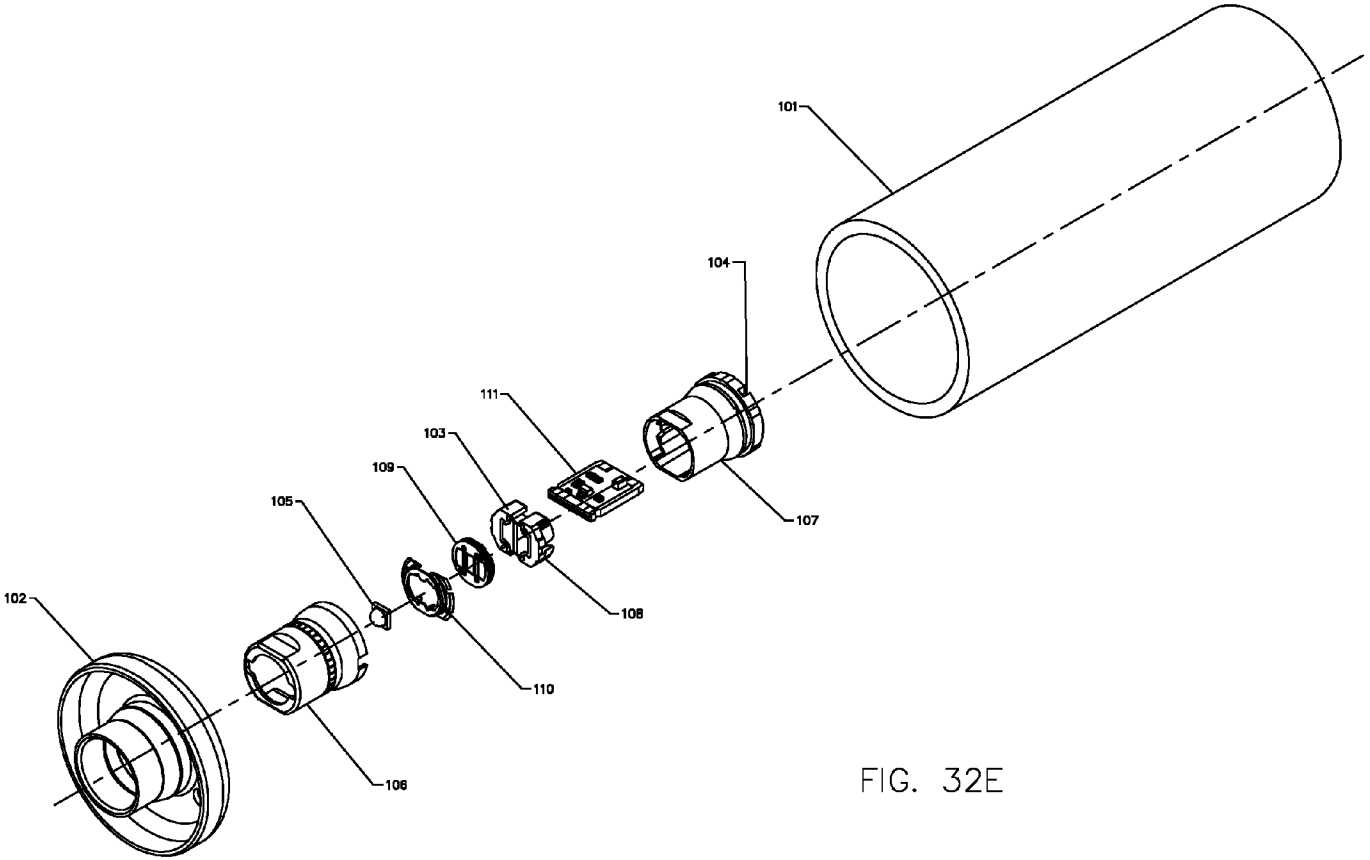
FIG. 32E PRIOR ART

FIG. 32B is a cross sectional view which is shown exploded in FIG. 32E while FIGS. 32A and 32C are, respectively, top and bottom views looking into the apparatus shown in cross section in FIG. 32B and FIG. 32D is an enlarged cutaway view of FIG. 32B.

FIGS. 33A-D show a widely used prior art star type, metal and ceramic backed PC board to which the LED is mounted and the multiple thermal junctions required to conduct heat to ambient air having the following identified elements:

101. Tube or barrel

102. Heatsink

105. LED

106. First power connection

107. Second power connection

108. Star PC board

Figure 33D:
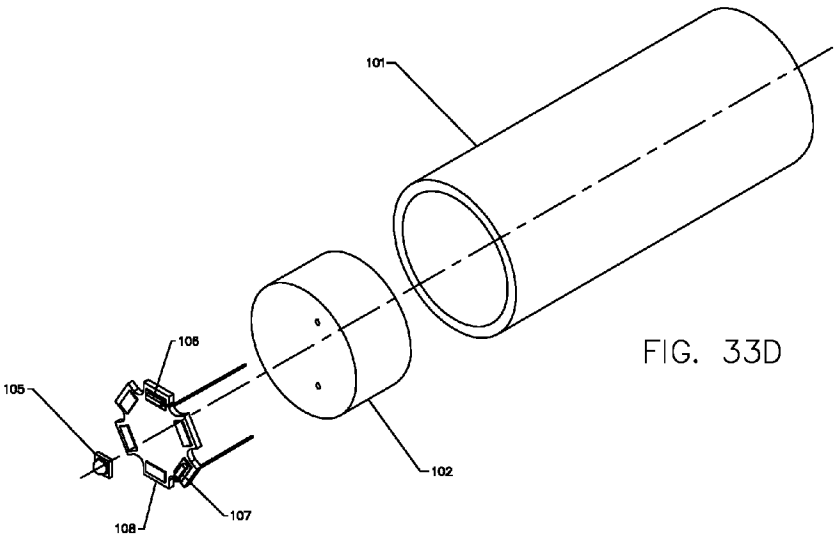
Figure 33C:
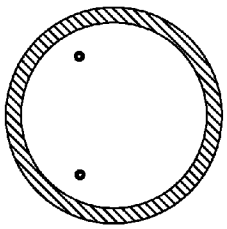
Figure 33B:
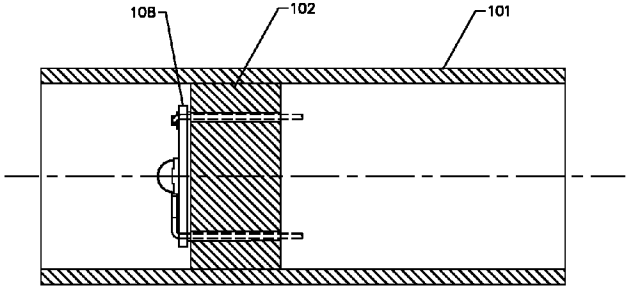
FIG. 33B PRIOR ART
Figure 33A:
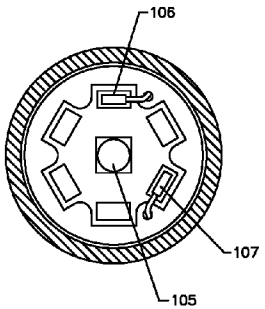

FIG. 33B is a cross sectional view which is shown exploded in FIG. 33D while FIGS. 33A and 33C are, respectively, top and bottom views looking into the apparatus shown in cross section in FIG. 33B.

Figure 34:
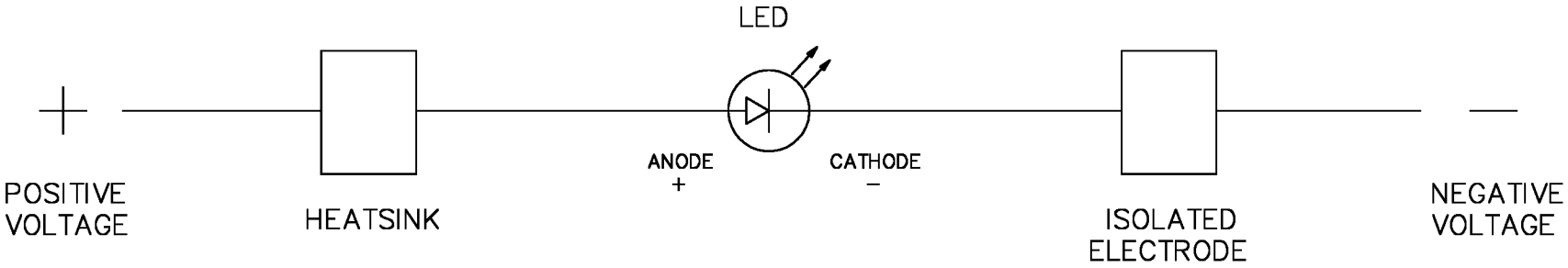

FIG. 34 is a block diagram of a typical heatsink mounted LED with positive polarity heatsink.

Figure 35:
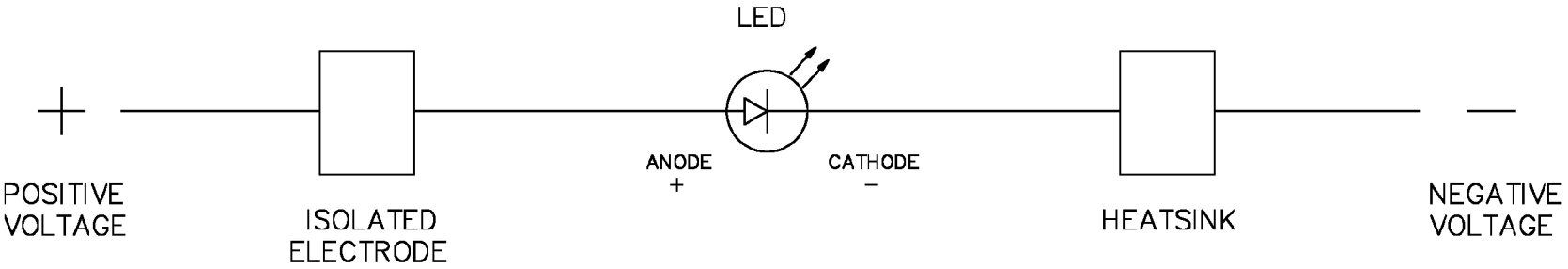

FIG. 35 is a block diagram of a typical heatsink mounted LED with negative polarity heatsink.

Figure 36:
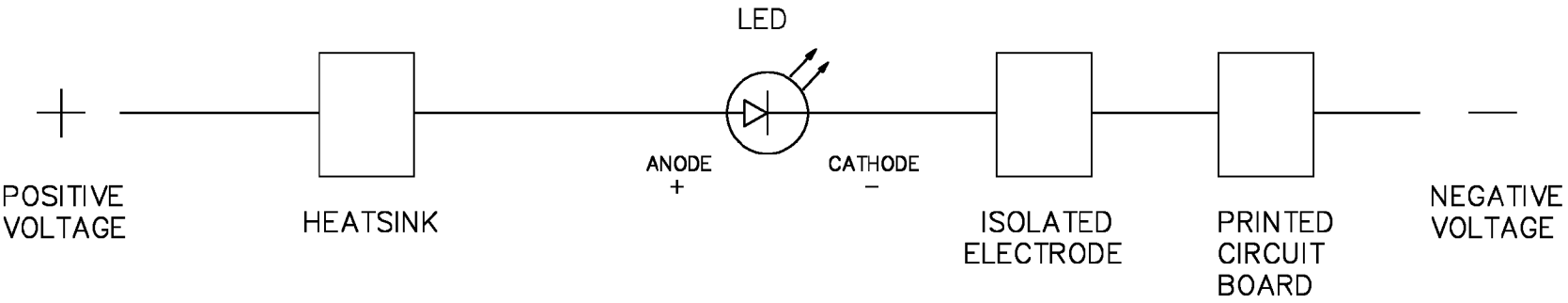

FIG. 36 is a block diagram of a typical heatsink mounted LED with a positive polarity heatsink that incorporates a PC board with LED drive electronics.

Figure 37:
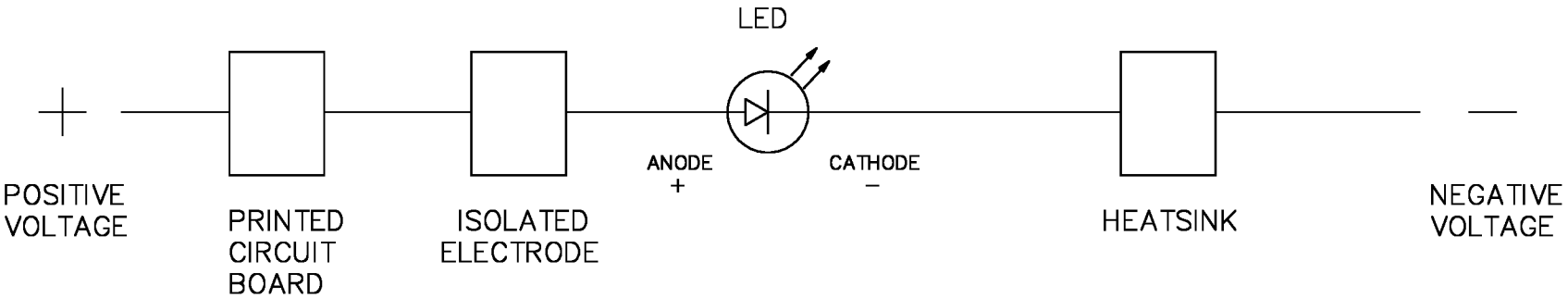

FIG. 37 is a block diagram of a typical heatsink mounted LED with a negative polarity heatsink that incorporates a PC board with LED drive electronics.

Figure 2:
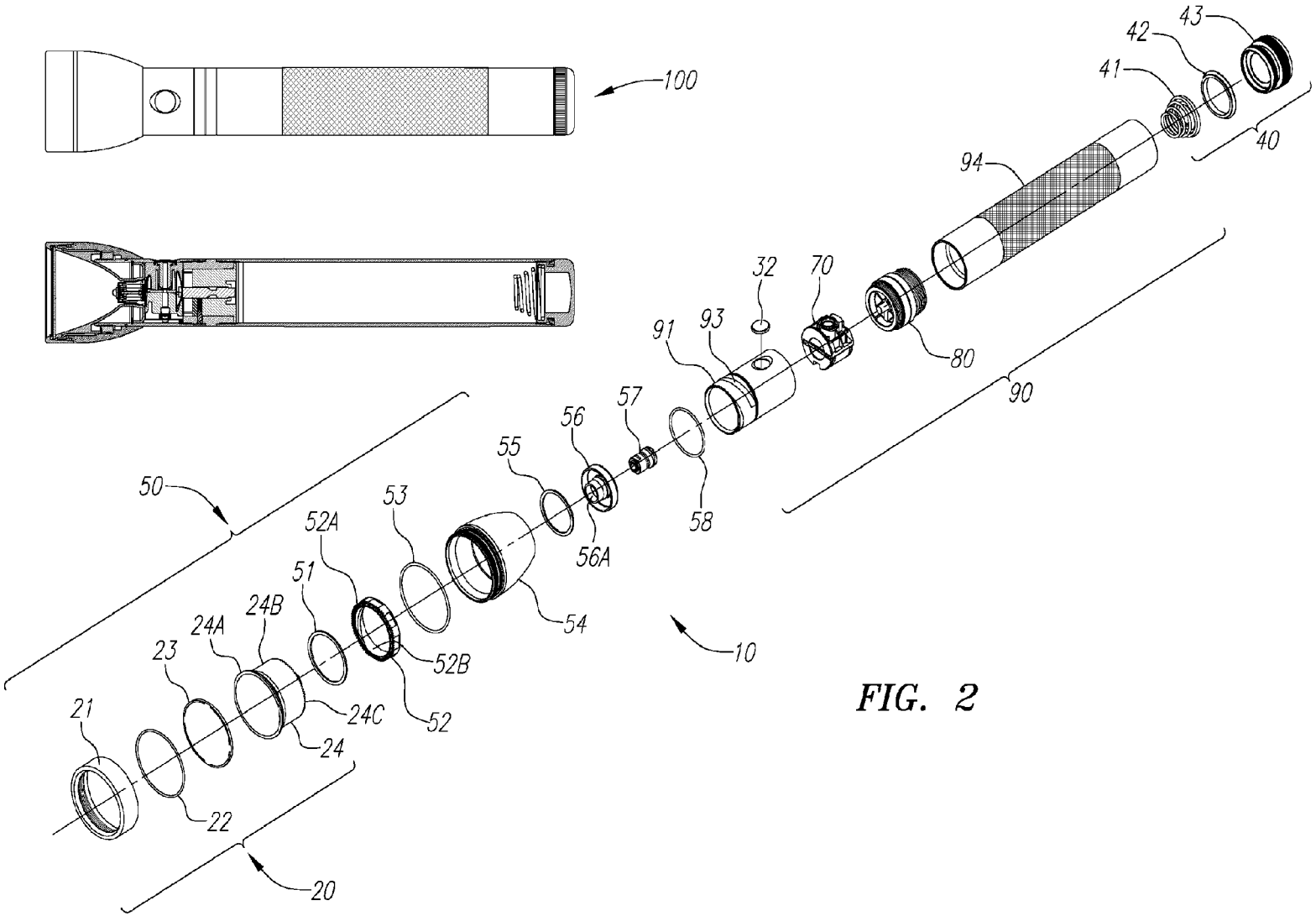
FIG. 2 is an exploded perspective view of a rechargeable flashlight.
Figure 38:
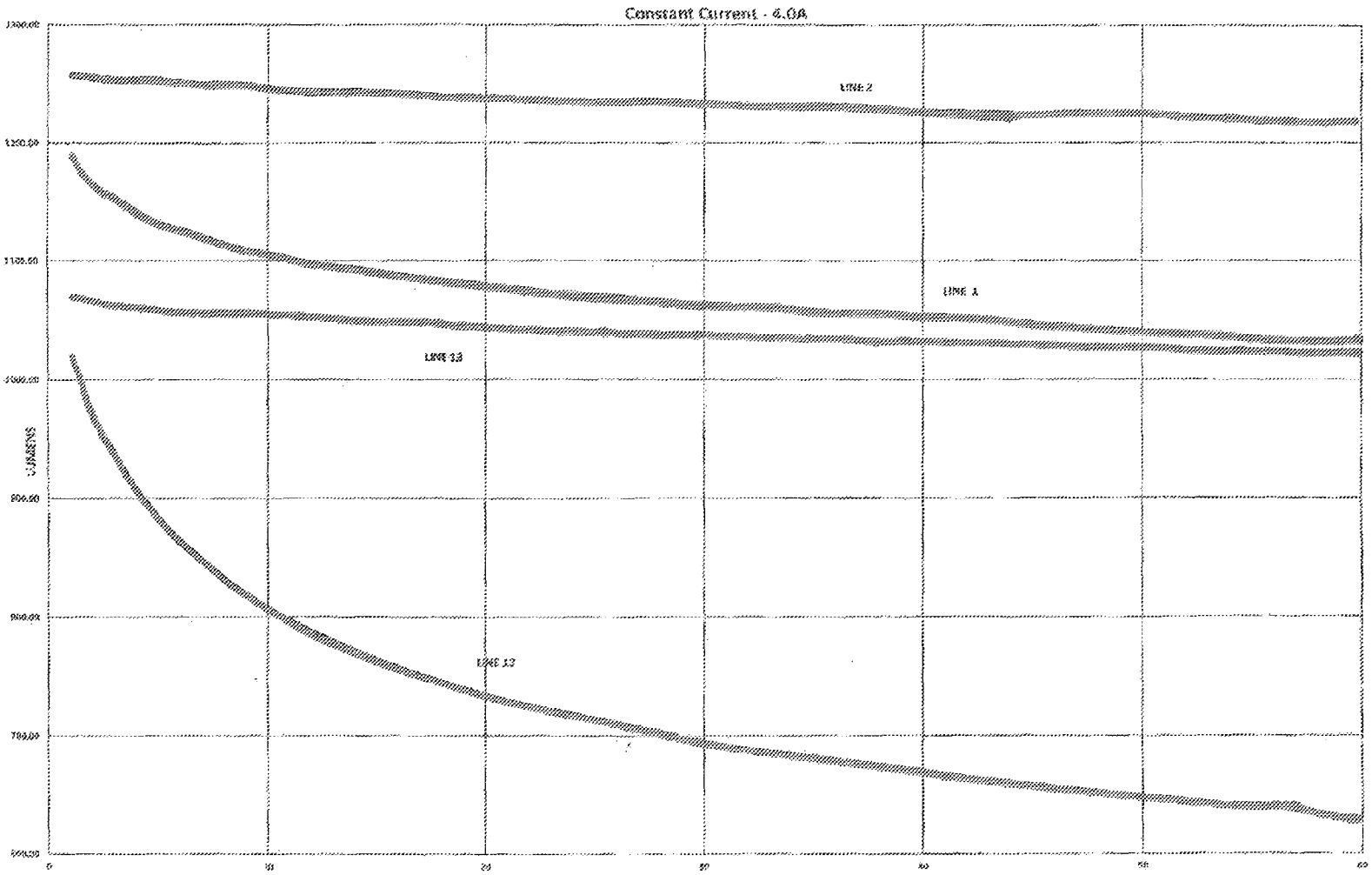

FIG. 38 is a comparison of the performance of four different heatsinking methods or systems. FIG. 2 curve is for the present invention and demonstrates superior performance with minimal drop off in lumens output over time.

1. Curve labeled LINE 1 is a graphical representation of the lumens output over time showing the drop off in performance as the LED heats and efficiency drops for the system of FIGS. 21A-D.
2. Curve labeled LINE 2 is a graphical representation of the lumens output over time showing very minimal drop off in performance as the LED heats and efficiency drops for the system of FIGS. 22A-D.
3. Curve labeled LINE 13 is a graphical representation of the lumens output over time showing the drop off in performance as the LED heats and efficiency drops for the system of FIGS. 33A-D.
4. Curve labeled LINE 12 is a graphical representation of the lumens output over time showing the drop off in performance as the LED heats and efficiency drops for the system of FIGS. 32A-E.

Figure 39A:
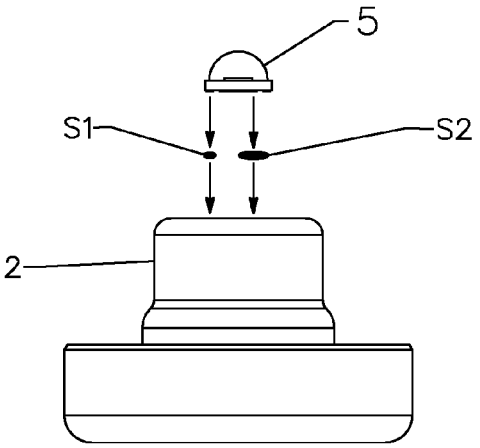
Figure 39B:
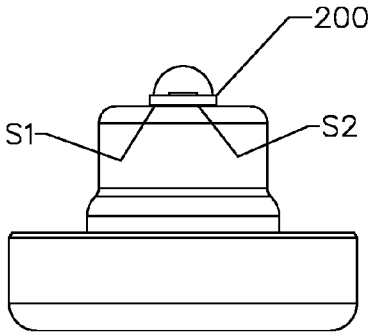
Figure 39C:
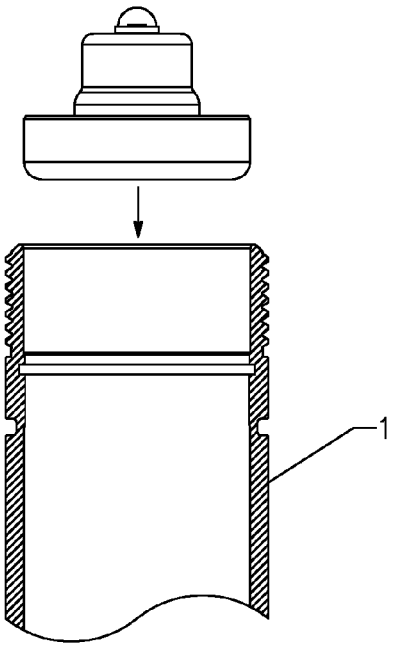
Figure 39D:
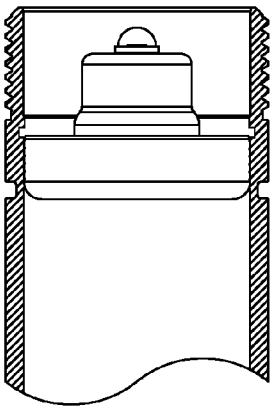

FIGS. 39A-B illustrate a process for manufacturing a heat sink assembly in accordance with the present invention in which solder S1 and S2 is used to solder pads of an LED 5 to a top surface of a heat sink 2 to form a heat sink assembly 200. FIGS. 39C-D illustrate a press fit step of inserting heat sink assembly 200 into a tube or barrel 1.

Figure 40A:
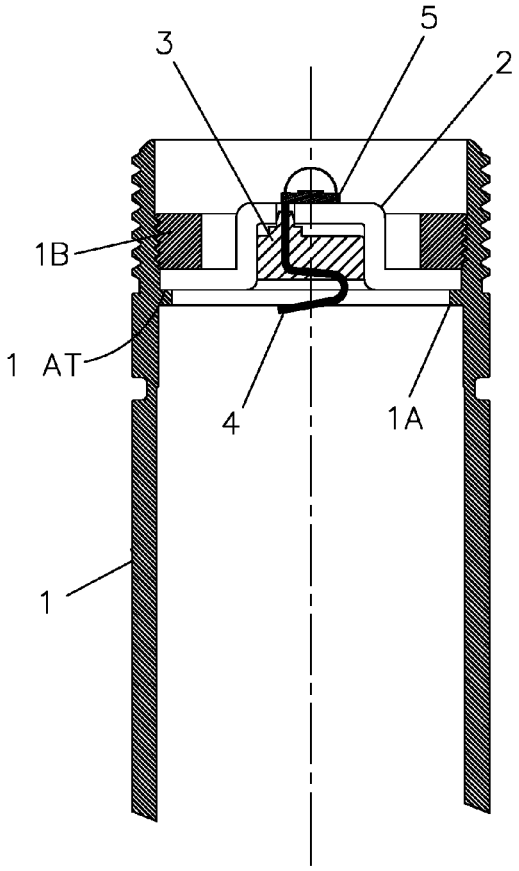
Figure 40B:
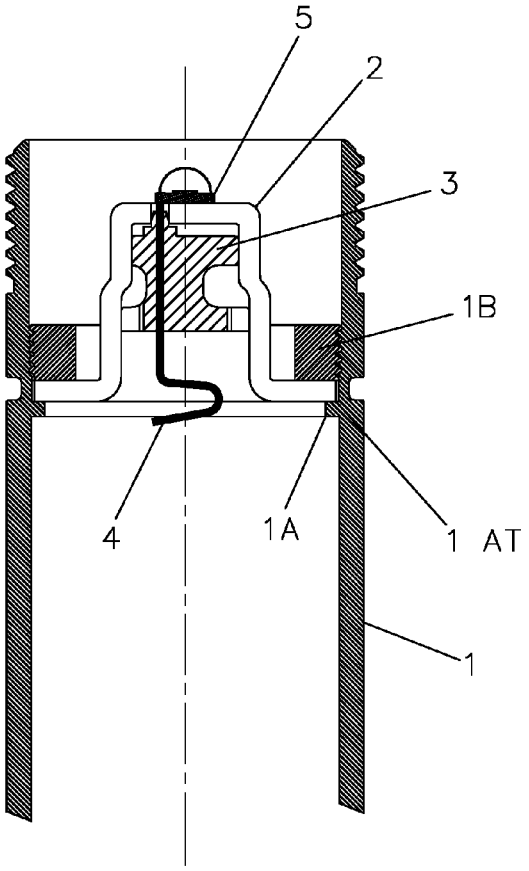

FIGS. 40A and 40B show variations on FIGS. 39C-D in which the heatsink and insulating core are installed in a metal tube or flashlight barrel having the following identified elements:

1. Tube or barrel
1A. Shoulder of tube or barrel 1
1AT. Top surface of shoulder 1A
1B. Nut
2. Heatsink
3. Insulator
4. Terminal to connect power to LED
5. LED

DETAILED DESCRIPTION OF THE PREFERRED EMBODIMENTS

The current invention relates to improved designs for lighting devices such as non-rechargeable and rechargeable flashlights. In a first aspect of the invention, simplified designs having fewer component parts and simplified interaction between component parts are described. These simplified designs preferably reduce the cost and complexity to manufacture the lighting device, make the lighting device easier to use by a user and increase the durability of the lighting device.

In another aspect of the current invention, the beam of light provided by the lighting device may be focused by moving the reflector in relation to the light source, where the light source may remain stationary. To this end, the head assembly which may include the reflector may move relative to the light source. This design may provide for quicker focusing of the light beam and improved concentricity of the light source axis and reflector axis. The focusing feature of the current invention may involve components which engage each other through teeth and a spiral groove and corresponding tab arrangement. As an alternative to engagement by a spiral groove and corresponding tab, components that provide for focusing may engage each other through corresponding starts and threads.

Another aspect of the invention regards the reflector used to focus the beam of light emanating from the lighting device. Many reflectors are made using an injection molding process with hot plastic. In this aspect of the invention, the reflector is preferably configured so that its walls are of relatively uniform thickness, and significantly thicker walls or portions are avoided. With this configuration, any shrinkage that occurs as the plastic cools down after the injection molding process is more uniform across the reflector walls due to their uniform wall thickness. Also, distortion in thicker portions that may result from "sink" is preferably reduced or is avoided. This in turn preferably avoids distortion to the reflector surface that might otherwise degrade the quality of the light beam.

Another aspect of the current invention regards a switch assembly that may include a printed circuit board (PCB) that provides various functions. The PCB may be located in a switch assembly. In a preferred embodiment, the PCB may include components that allow the lighting device to control the brightness and dimming of the light source in an analog fashion; though this control may also occur through pulse width modulation (PWM).

Another aspect of the current invention regards a heat sink that may provide several functions. The heat sink may generally hold a light source module that includes the light source, such as an LED, that generates significant heat. The heat sink may provide heat transfer, electrical conductivity and concentricity functions. That is, the heat sink may conduct heat away from the light source, may form part of the electrical circuit between the light source and the power source and may facilitate the concentricity between the light source and reflector axis when the focus of the light beam is varied.

Another aspect of the current invention regards the ability to provide different operational modes and the manner in which a user may switch from one mode to another. In this aspect of the invention, the user may press or click on a button or other type of switch or user interface a certain number of times to select different modes of operation. Certain modes may be also selected by holding down the button or switch for more than a predetermined time. A combination of both of the above may also be used to select modes. Different sets of modes may also be chosen by the user to suit his or her preferences. For example, a user may choose a set of modes which may include modes generally used more often. The modes may also be ordered within a set so that the mode most frequently used may be ordered first.

Another aspect of the invention regards providing a brighter beam of light. This may occur by using more powerful light sources, such as a larger LED. To this end, the invention also regards the manner in which the lighting device may accommodate a larger light source.

The current invention is now described with reference to the figures. The same or similar components appearing in more than one figure may bear the same reference numeral. It should be noted that the scope of the current invention is not limited to the examples specifically shown and discussed herein, but also includes alternatives thereto.

Figure 1:
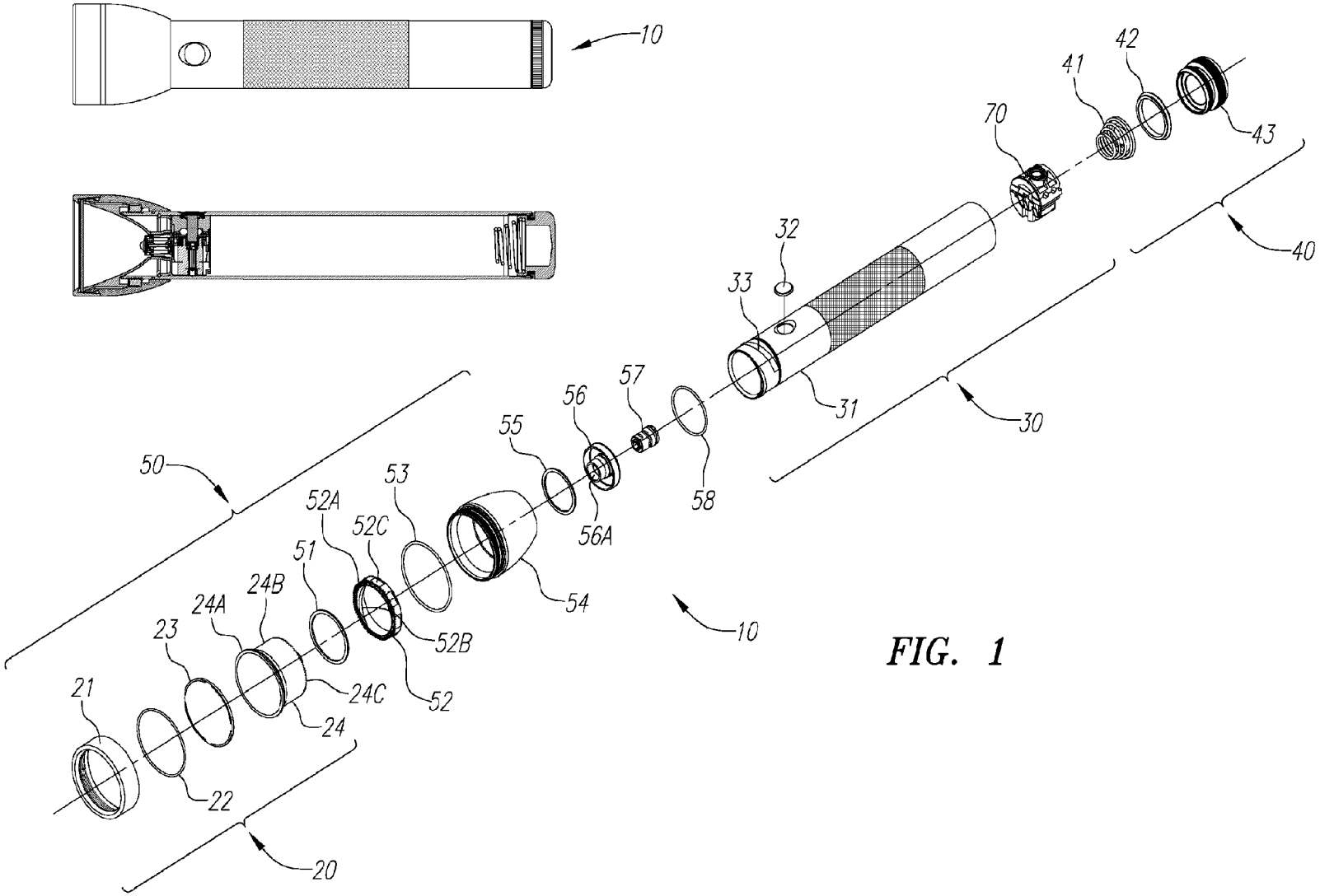
FIG. 1 is an exploded perspective view of a flashlight.

The overall design and operation of lighting devices reflecting the current invention are first described with reference to FIGS. 1 and 2. FIG. 1 shows a flashlight 10 having a non-rechargeable power source, while FIG. 2 shows a flashlight 100 having a rechargeable power source. The overall designs of rechargeable flashlight 100 and non-rechargeable flashlight 10 may be similar and may include a number of the same or similar components.

As shown in FIG. 1, flashlight 10 may generally comprise face cap assembly 20, barrel assembly 30, tail cap assembly 40, head assembly 50 and switch assembly 70. Similarly, as shown in FIG. 2, rechargeable flashlight 100 may comprise face cap assembly 20, barrel assembly 90, tail cap assembly 40, head assembly 50 and switch assembly 70. A power source is not shown in either FIG. 1 or 2, but non-rechargeable batteries or a rechargeable battery pack may be used. To this end, the battery or batteries preferably fit within barrel 31, 94 and may engage tail cap assembly 40 and switch assembly 70.

The flashlights 10, 100 of FIGS. 1 and 2 show a cylindrical barrel 31, 94, but it should be noted that the current invention is not limited to cylindrical flashlights. To this end, different types of housings besides barrels may be used to house a power source, and different shapes of housings and power sources may be used.

The general construction of flashlights 10, 100 is now further described. In flashlight 10, face cap assembly 20 may generally form part of head assembly 50, which may in turn be attached to the forward portion of barrel assembly 30. Tail cap assembly 40 may be attached to the rear portion of barrel assembly 30. Switch assembly 70 may reside within barrel assembly 30 and provide an interface with the user. As explained in more detail below, head assembly 50 may be rotated relative to barrel assembly 30 to focus the beam of light. Rechargeable flashlight 100 may generally have the same construction in that face cap assembly 20 may form part of head assembly 50, which may be attached to the forward portion of barrel assembly 90, and more particularly, attached to the forward portion of front barrel 91. Tail cap assembly 40 may be attached to the rear portion of barrel assembly 90, and more particularly to the rear portion of rear barrel 94. The barrel assembly 90 may include front barrel 91, diode assembly 80 and rear barrel 94. This barrel assembly 90 may differ from barrel assembly 30 of non-rechargeable light 10 in that diode assembly 80 provides a means for recharging the power source. Switch assembly 70 may reside within front barrel portion 91.

The components that may be included in the various assemblies identified above are now further discussed. Referring to FIGS. 1 and 2, face cap assembly 20 in either of flashlights 10, 100 may comprise face cap 21, lens o-ring 22, lens 23 and reflector 24. In a preferred embodiment, face cap 21 may comprise aluminum. O-ring 22 may comprise rubber or any other suitable material. Lens 23 may comprise a polycarbonate for durability and resistance against scratching and is preferably clear. In a preferred embodiment, lens 23 may comprise LEXAN. Reflector 24 may generally comprise plastic. As shown in more detail in FIG. 3, reflector 24 may be formed so that its inner surface 24D is parabolic so as to reflect the light beam out of flashlight 10, 100. To provide reflectivity, the inner surface of reflector 24 may also be coated with a reflective material.

Face cap 21 may contain a groove to receive lens o-ring 22, and a threaded portion within its inner diameter to engage the threads on head 54 as described in more detail below. Lens o-ring 22 may reside between face cap 21 and lens 23 to provide a watertight seal and to also protect against dirt from entering face cap assembly 20. Reflector 24 may include a flange 24A that fits within face cap 21, and also a cylindrical portion 24B, the inner surface 24D of which may be parabolic and which may reflect light. Reflector 24 may also include a back surface 24C having teeth that engage spiral nut 52 as described in more detail below. When face cap assembly 20 is assembled, reflector flange 24A may be pushed forward towards face cap 21 to hold o-ring 22 and lens 23 in place.

The components of head assembly 50 are now further described. Head assembly 50 may generally comprise the face cap assembly 20 described above, as well as snap ring 51, spiral nut 52, o-ring 53 and head 54. Snap ring 51 may comprise a resilient metal, spiral nut 52 may comprise plastic, o-ring 53 may comprise rubber and head 54 may comprise aluminum. Other suitable materials may be used. When assembled, o-ring 53 acts as a seal between face cap 21 and head 54.

Spiral nut 52 may include a front surface having teeth 52A that engage the teeth 24C of reflector 24 when the face cap assembly 20 and head assembly 50 are assembled. Spiral nut 52 may also include spiral tab 52B formed on its inner surface. As discussed in more detail below, snap ring 51 may generally serve to prevent head assembly 50 from being removed from barrel assembly 30, 90 during use after flashlight 10, 100 is completely assembled.

Flashlights 10, 100 may also include snap ring 55, heat sink 56, light source module 57 and o-ring 58. These components may reside at or near the front of barrel assembly 30, 90. In general, light source module 57 may include an LED as its light source, and may be press fit into the central hole 56A of heat sink 56. Heat sink 56 may be press fit into the forward portion of barrel 31 of flashlight 10, or into the forward portion of front barrel 91 of rechargeable flashlight 100.

As noted above, switch assembly 70 may reside within barrel 31 or front barrel 91. Switch assembly 70 is positioned so that it is located proximate to hole and interface 32 which may serve as an interface with the user. Interface 32 may comprise a push button switch. O-ring 58 may be placed on the outside of barrel 31, 91. When flashlight 10, 100 is assembled, o-ring 58 may act as a seal between head assembly 50 and barrel 31, 91.

Barrel assembly 30 as used in flashlight 10 of FIG. 1 may include barrel 31 and interface 32 as mentioned above. Barrel 31 may comprise aluminum and may include a knurling pattern as shown. Barrel 31 also preferably includes spiral groove 33 on its outer surface which may engage the spiral tab 52B of spiral nut 52 as described in more detail below. The forward portion of barrel 31 may also include grooves to receive snap rings 51, 55. The groove to receive snap ring 51 may be located on the outer surface of barrel 31, and the groove to receive snap ring 55 may be located on the interior surface of barrel 31.

Barrel assembly 90 as used in flashlight 100 of FIG. 2, may include front barrel 91, diode assembly 80 and rear barrel 94. The rear portion of front barrel 91 may include interior threads which engage exterior threads on the front portion of diode assembly 80. Similarly, the front portion of rear barrel 94 may include interior threads which engage the exterior threads on the rear portion of diode assembly 80. Front and rear barrels 91, 94 may comprise aluminum, and rear barrel 94 may include a knurling pattern as shown. Front barrel 91 also preferably includes spiral groove 93 on its outer surface which may engage the spiral tab 52B of spiral nut 52 as described in more detail below. The forward portion of front barrel 91 may also include grooves to receive snap rings 51, 55. The groove to receive snap ring 51 may be located on the outer surface of front barrel 91, and the groove to receive snap ring 55 may be located on the interior surface of front barrel 91.

Tail cap assembly 40 may include spring 41, lip seal 42 and tail cap 43. Spring 41 may serve to urge the power source forward so as to help maintain electrical contact between the power source and switch assembly 70. Lip seal 42 may comprise rubber and may help prevent water and dirt from entering the seam between the barrel assembly 30, 90 and tail cap 43. Lip seal 42 may be configured to allow venting of pressure caused by the build-up of gases within barrel 31, 94 due to the chemistry of the batteries contained therein. This provides an additional feature beyond existing flashlights where an o-ring may be used in the tail cap assembly that does not provide venting. Tail cap 43 may comprise aluminum and may also include a knurling pattern as shown.

An advantage of the current invention is that the design of flashlights 10, 100, as well as the other embodiments described later, preferably involve fewer components. This preferably improves reliability and reduces the cost of manufacturing. The manner in which these components may be assembled may also contribute to the reduced number of components, and is now further described. It should be noted that the manner of assembly described below is only an example and is not intended to limit the scope of the invention.

In the case of flashlight 10 of FIG. 1, switch assembly 70 may be inserted into barrel 31 so that it is positioned in proximity to hole and interface 32. Light source module 57 may be press fit into heat sink 56, and heat sink 56 may be press fit into the front portion of barrel 31. Snap ring 55 may then be inserted into barrel 31, and may engage an internal groove (not shown) of barrel 31 so as to hold heat sink 56 and thus light module 57 in place. In this manner, the back surface of light module 57 may engage switch assembly through electrical contacts as described later.

Face cap assembly 20 may be assembled first by inserting lens o-ring 22, lens 23 and reflector 24 into face cap 21. O-ring 53 may be installed in a groove on the outside of head 54. Head 54 may then be positioned on the front portion of barrel 31. Spiral nut 52 may also be positioned on the front portion of barrel 31 and press fit into head 54. To this end, spiral nut 52 may include surfaces 52C that may engage corresponding surfaces (not shown) on the interior surface of head 54. Corresponding surfaces need not be used, and the invention includes other means for spiral nut 52 to engage head 54. The press fit or other engagement between spiral nut 52 and head 54 thus preferably provide that head 54 and spiral nut 52 move together during use of flashlight 10 when head assembly 50 is rotated relative to barrel assembly 30 to vary the beam of light of flashlight 10. As spiral nut 52 is positioned on barrel 31, it is preferred that its spiral tab 52B engages the spiral groove 33 on barrel 31.

Snap ring 51 may then be positioned onto barrel 31 to engage an exterior groove. Once snap ring 51 is so engaged, it preferably prevents head 54 and spiral nut 52 from being removed from the front end of barrel 31. Accordingly, when flashlight 10 is later used and head assembly 50 rotated relative to barrel assembly 30, head assembly 50 is preferably not removed from barrel assembly 30.

O-ring 53 may be inserted onto head 54 and face cap assembly 20 may be attached to head 54 by the engagement of the interior threads of face cap 21 and the exterior threads of head 54. However, it should be noted that other means to attach face cap assembly 20 to head 54 may be used.

When face cap assembly 20 is brought into contact with head 54, it is preferred that the reflector teeth 24C engage the spiral nut notches 52A so that the teeth of one component engage the notches of the other and vice versa. As face cap assembly 20 is tightened onto head 54, the components therein are brought into close contact with each other to secure them together. In this manner, lens o-ring 22, lens 23, reflector 24 and spiral nut 52 are held tightly together within face cap 21 and head 54. This includes the engagement of teeth 24C, 52A between reflector 24 and spiral nut 52.

In the case of rechargeable flashlight 100 of FIG. 2, the assembly may generally be the same. Several differences may be that snap ring 51 engages an exterior groove on front barrel 91, snap ring 55 engages an interior groove on front barrel 91, and spiral tab 52B may engage the spiral groove 93 on front barrel 91.

When flashlights 10, 100 are so assembled, head assembly 50 may be rotated relative to barrel assembly 30, 90, and because of the engagement between spiral tab 52B and spiral groove 33, 93, and because of the engagement of reflector teeth and notches 24C and spiral nut teeth and notches 52A, rotation of head assembly 50 relative to barrel assembly 30, 90 results in head assembly 50 axially translating relative to the barrel 31, 91. This causes reflector 24 to move axially relative to the light source contained in light source module 57 that is itself held stationary by heat sink 56 and barrel 31, 91.

This relative movement of reflector 24 and the light source provides the focusing feature of the current invention. That is, moving the reflector 24 relative to the stationary light source changes the angle at which light emanating form the light source is reflected through lens 23. In this manner, the beam of light provided by flashlight 10, 100 may be varied from spot to flood and from flood to spot by twisting the head 50 relative to the barrel 30, 90. Generally, the light may be considered as focused when in the spot configuration. Here, the light emanating from flashlight 10, 100 may be collimated because the reflector is positioned relative to the light source, so that the light source is positioned at the focal point of reflector 24.

Figure 14:
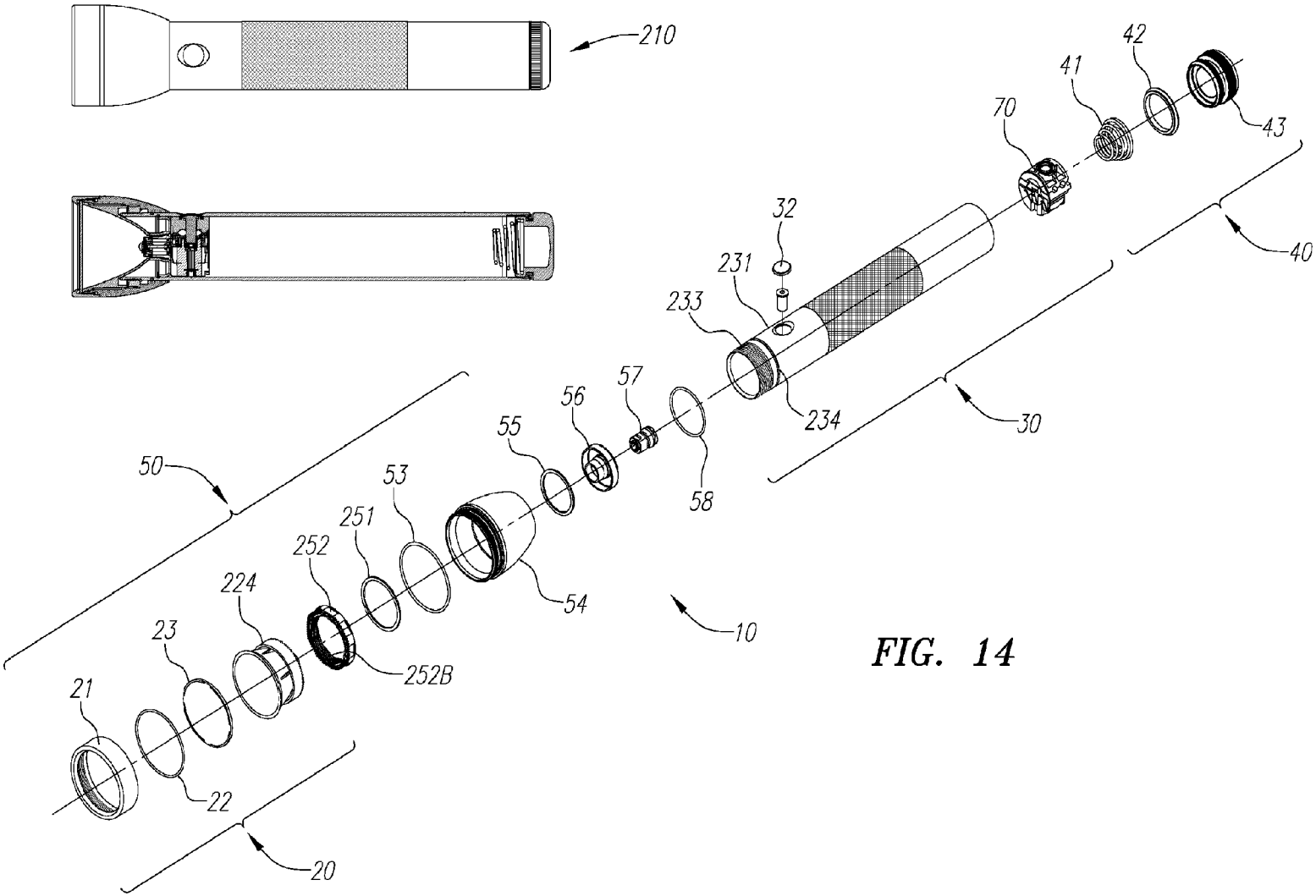
FIG. 14 is an exploded perspective view of a flashlight.
Figure 15:
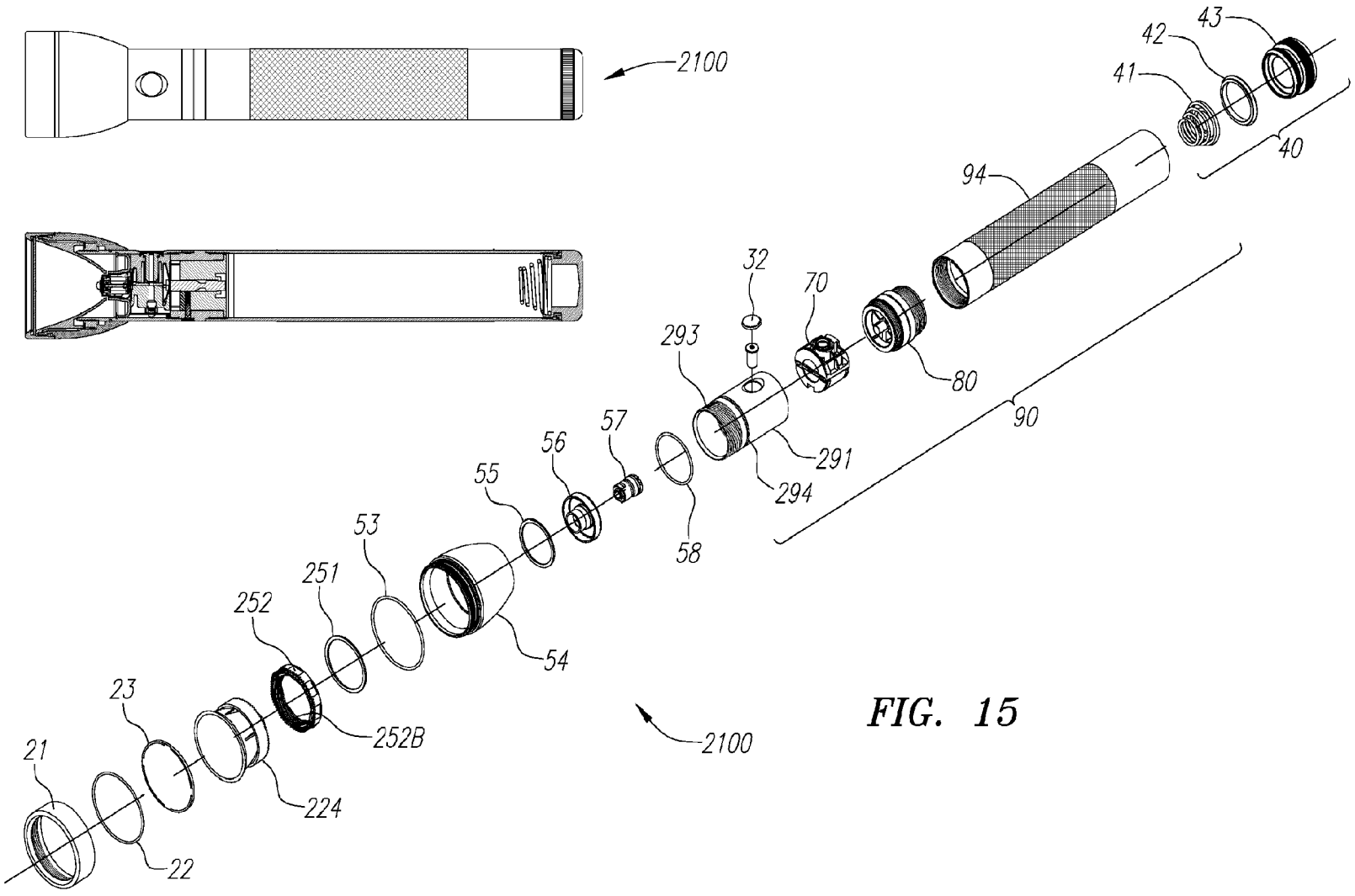
FIG. 15 is an exploded perspective view of a rechargeable flashlight.

Additional embodiments of the current invention are now described with reference to FIGS. 14 and 15. FIG. 14 shows non-rechargeable flashlight 210 and FIG. 15 shows rechargeable flashlight 2100. Flashlights 210, 2100 are generally similar to flashlights 10, 100 of FIGS. 1 and 2, respectively, though certain components differ as discussed below. Accordingly, many components in FIGS. 14 and 15 are identified by the same reference numerals used above. But where components in FIGS. 14 and 15 vary from those shown in FIGS. 1 and 2, different reference numerals are used.

Several components of non-rechargeable flashlight 210 in FIG. 14 which may vary from those described with non-rechargeable flashlight 10 in FIG. 1 are reflector 224, snap ring 251 and spiral nut 252. Also, barrel 231 of non-rechargeable light 210 may differ from barrel 31 in that barrel 231 may include threads or starts 233 at or near its front end as opposed to spiral groove 33. Another difference is that barrel 231 may include groove 234 located behind starts 233 to receive snap ring 251, as opposed to the groove in barrel 31 that receives snap ring 51 and that is located in front of spiral groove 33.

Similarly, with respect to the rechargeable flashlight 2100 as compared to rechargeable flashlight 100, reflector 224, snap ring 251 and spiral nut 252 may differ. And front barrel 291 may differ from front barrel 91 in that front barrel 291 may include threads or starts 233 at or near its front end as opposed to spiral groove 33. Another difference is that barrel 231 may include groove 234 located behind starts 233 to receive snap ring 251, as opposed to the groove in barrel 31 that receives snap ring 51 and that is located in front of spiral groove 33.

Reflector 224 is now further described with reference to FIGS. 16, 16A and 16B. Reflector 224 may be used in either non-rechargeable flashlight 210 or rechargeable flashlight 2100. Similar to reflector 24 in FIGS. 1 and 2, reflector 24 may reside within face cap assembly 20 and head assembly 50.

Reflector 224 may include flange portion 224A, cylinder or cylindrical portion 224B, a series of teeth and notches 225C on the rear surface of cylinder 224B, and parabolic portion 224E that includes a parabolic inner surface 224D that serves to direct the light beam. Cylinder 224B may be connected to parabolic portion 224E by a plurality of ribs 226. Generally, reflector 224 may serve the same purpose of focusing the light beam as does reflector 24.

Reflector 224 may fit within face cap 21 as discussed above in connection with reflector 24. As best shown in FIG. 16, flange portion 224A may include one or more tabs 225 spaced about its periphery. In a preferred embodiment, six tabs 225 may be used but other numbers of tabs may also be used. Tabs 225 preferably serve to retain reflector 224 within face cap 21 during manufacturing process. It will be recalled that the components within the face cap 20 assembly and head assembly 50 are ultimately pressed together and secured firmly in place as face cap 21 is tightened onto head 54. But prior to then, during the manufacturing process, these components may be loosely fitted together. However, tabs 225 preferably hold reflector 224 in place within face cap 21 until face cap 21 is tightened onto head 54 so as to aid in the manufacturing process.

Figure 16:
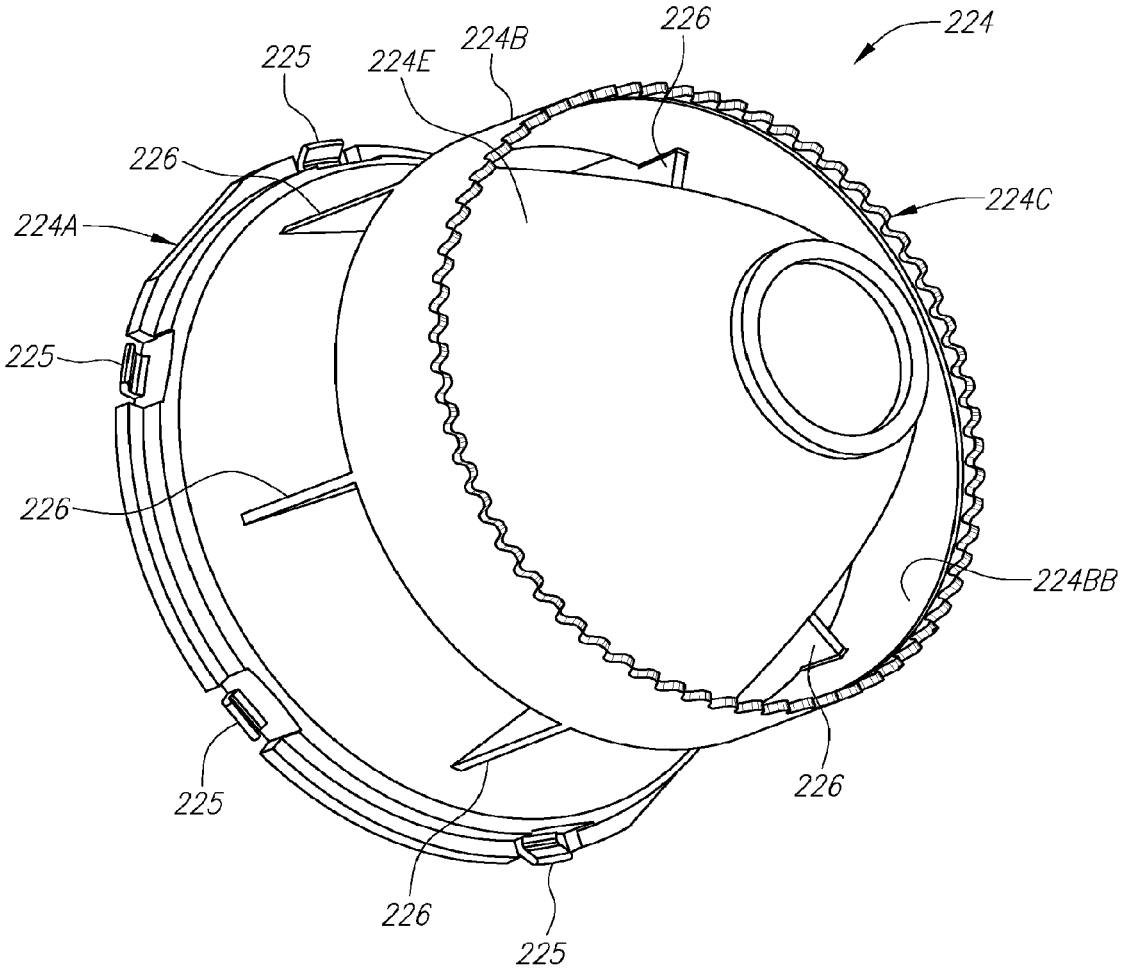
FIG. 16 is a perspective view of a reflector.

Another benefit of reflector 224 relates to the space between cylinder 224B and parabolic portion 224E, which is best shown in FIG. 16. As noted above, cylinder 224 may be attached to parabolic portion 224E by ribs 226, and ribs 226 may provide the space between cylinder 224B and parabolic section 224E. The reason why this space is beneficial is better understood when considering the materials and manufacturing process that is oftentimes used to produce reflectors for lighting devices such as flashlights.

The reflectors used in many flashlights and other lighting devices are produced by an injection molding process where heated fluid plastic is injected into a mold of the desired reflector shape and configuration. After the plastic is injected into the mold, the plastic cools so that it ultimately hardens to form the reflector. As the plastic cools, it typically shrinks. However, the amount of shrinkage that occurs may vary between different regions of the reflector depending on various factors such as how thick the reflector walls are in a particular region. If the shrinkage is not uniform, the reflector may be distorted which may affect the reflector surface, e.g., surface 224D, which may in turn degrade the quality of the light beam emanating from the lighting device.

For example, a condition referred to as "sink" may occur in the thicker walled regions of an injection molded reflector. Sink may occur where the amount of plastic entering the mold is less than the volume of plastic the mold was designed to receive. This situation typically occurs at points in the mold where thicker regions of the part are to be formed, i.e., at those regions in the mold where the volume of plastic to be received is larger. When insufficient plastic is received by the mold in these regions, the resulting thicker cross sections of the reflector will sink because insufficient plastic was injected to form and support these thicker sections. Where the thicker regions adjacent to the parabolic inner surface (such as surface 224D) of the reflector experience sink, this will tend to distort this surface and degrade the quality of the light beam emanating from the lighting device.

Besides sink, distortion problems may also occur where the thickness of the reflector walls vary significantly. This is because as the plastic cools, thicker portions may simply experience different shrinkage than thinner portions. And if this gradient in shrinkage is in proximity to the inner parabolic surface of the reflector, distortion may ultimately exist and degrade the quality of the light beam.

Reflector 224 reduces or avoids these distortion issues by essentially avoiding thicker cross sectional walls by separating cylinder 224B from the outside of parabolic portion 224E as best shown by FIG. 16. This space is partly created by the fact that the axial length of cylinder 224B does not extend all the way forward so that it merges with parabolic portion 224E as does cylindrical portion 24B with the parabolic portion of reflector 24. This space between the outside of parabolic section 224E and the inner surface 224BB of cylinder 224B is also made possible by ribs 226 holding cylinder 224B at a distance from parabolic portion 224E.

This is in contrast to the situation where cylinder 224B comprises a larger mass of material that simply bridges the gap to parabolic portion 224E all around its circumference. In that situation, one may see how the effective wall thickness in the region where the cylindrical portion merges with the parabolic section would be significantly larger.

Figure 3:
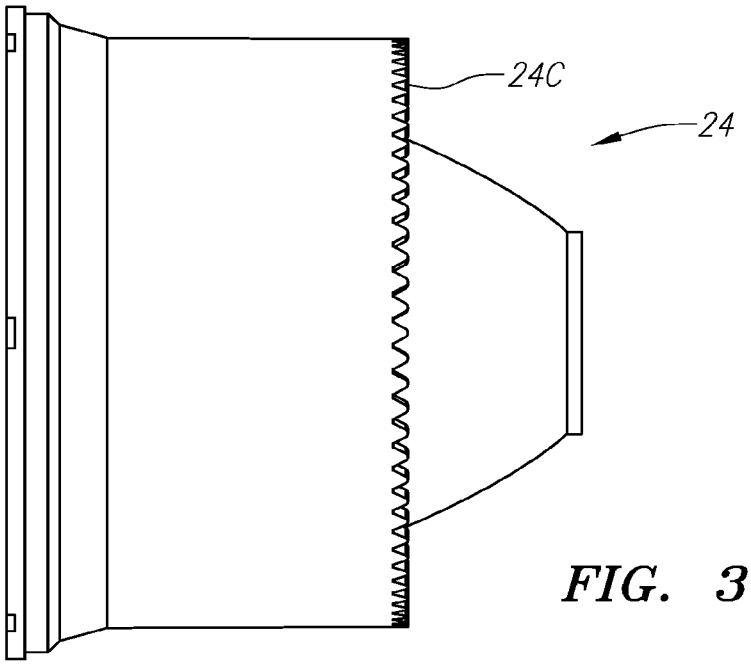
FIG. 3 is a side view of a reflector.
Figure 3A:
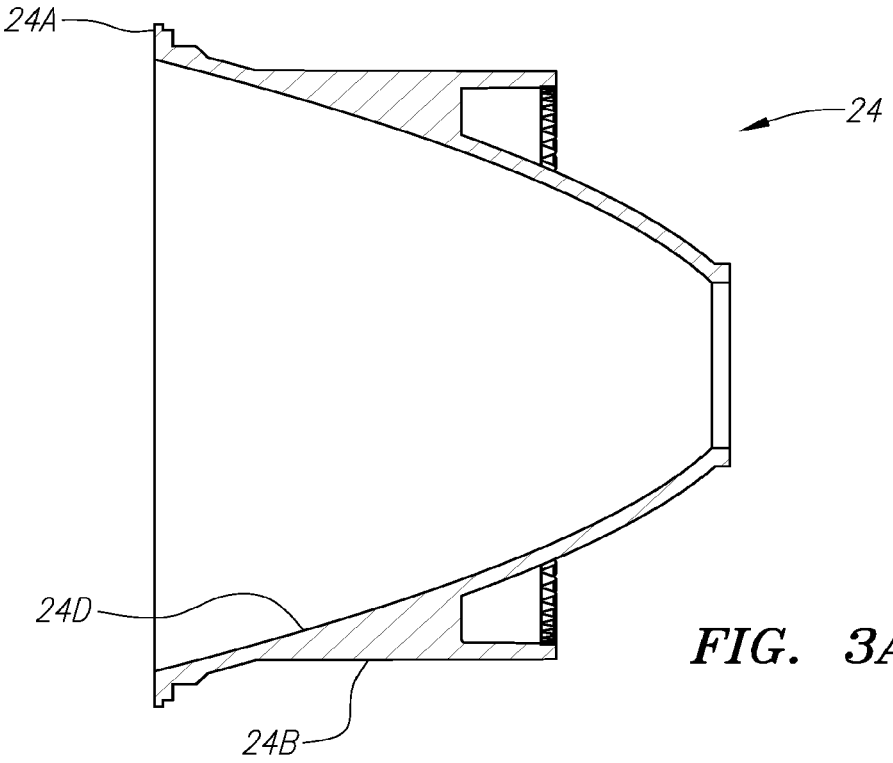
FIG. 3A is a section view of a reflector.
Figure 4:
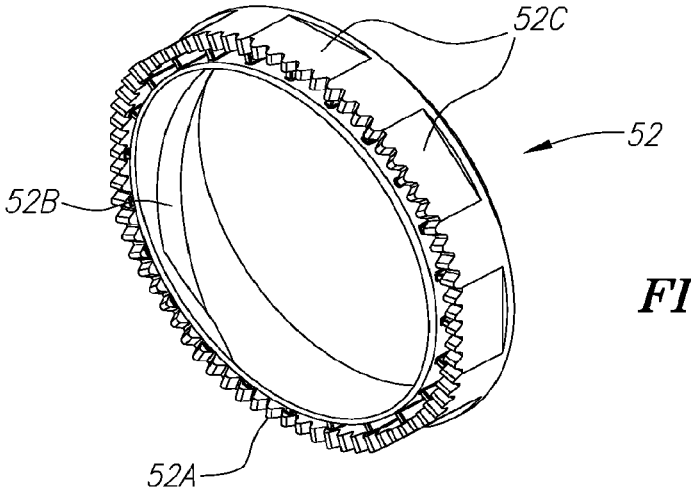
FIG. 4 is a perspective view of a spiral nut.
Figure 4A:
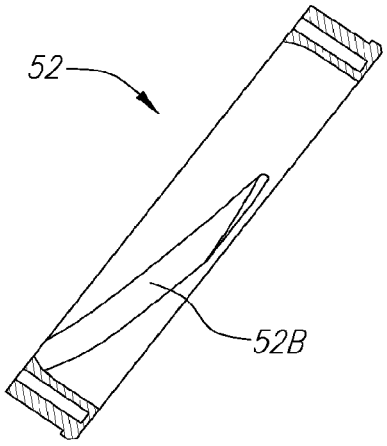
FIG. 4A is a section view of a spiral nut.
Figure 4B:
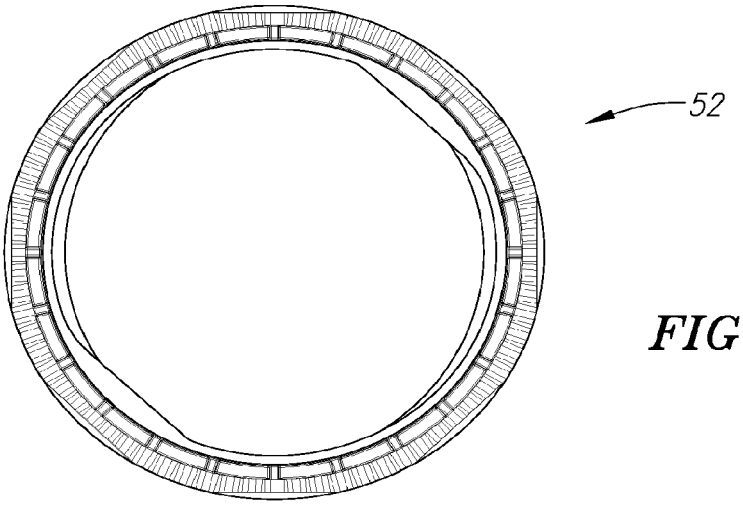
FIG. 4B is a front view of a spiral nut.

As an example, this effectively thicker wall region may be seen by the section view of reflector 24 in FIG. 3A. This thicker region is created due to the angle of the parabolic section, the positioning of the cylindrical section 24B, and the fact that the cylindrical section 24B is configured to extend all the way forward to merge with the parabolic section. Furthermore, this thicker region extends around the periphery of reflector 24 because the parabolic and cylindrical sections merge around the reflector's entire circumference. Accordingly, there is a significant volume of material that may be susceptible to sink. If sink were to occur with the embodiment of reflector 24, it may distort the parabolic surface 24A and degrade the quality of the light beam.

Besides any distortion caused by sink, reflector 224 avoids significantly different thicknesses in its walls. Accordingly, any distortion that may be caused by non-uniform shrinkage due to varying thicknesses is also preferably reduced or avoided.

Figure 16A:
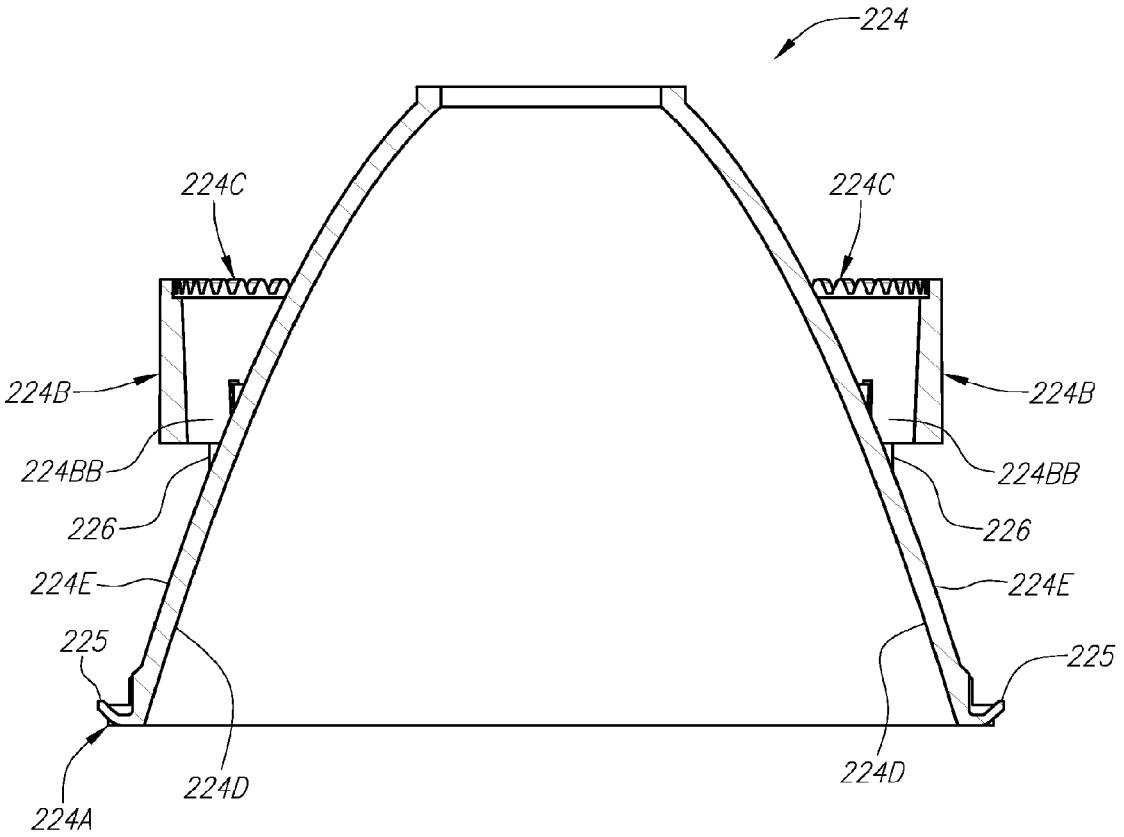
FIG. 16A is a section view of a reflector taken along a first section line.
Figure 16B:
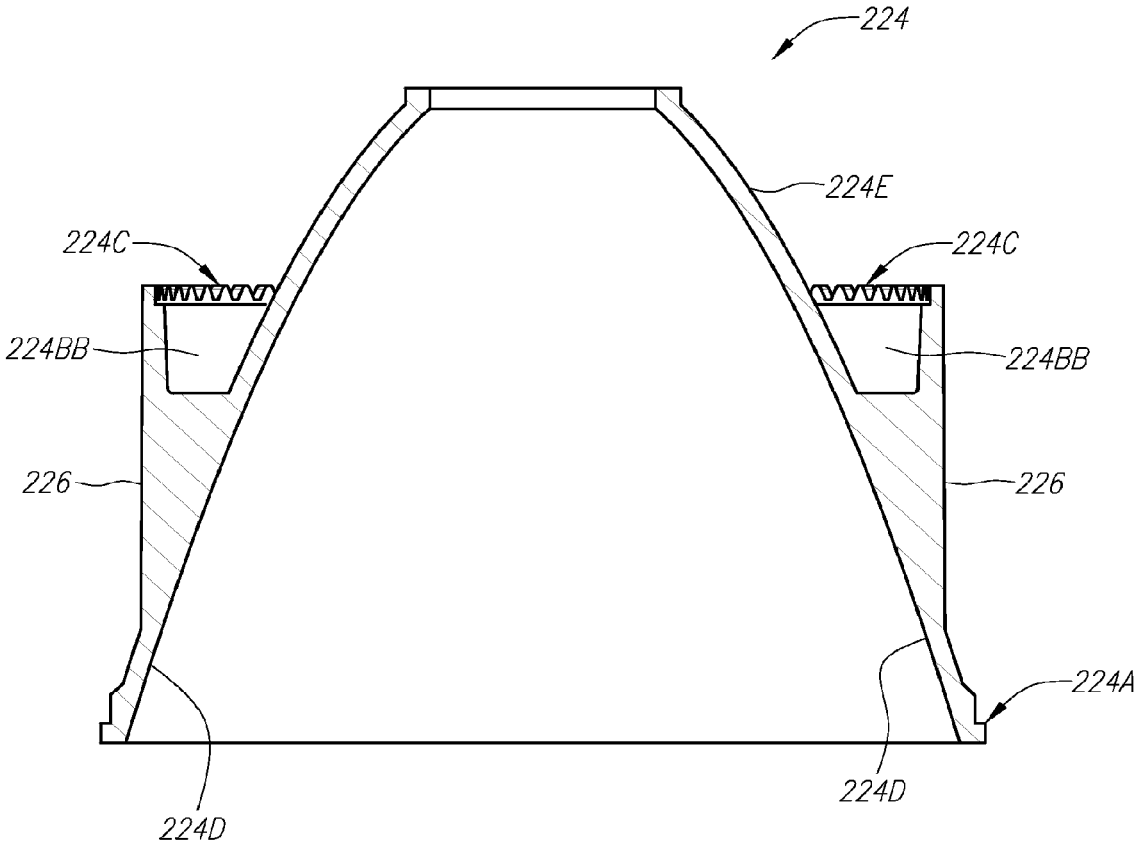
FIG. 16B is a section view of a reflector taken along a second section line.

FIGS. 16A and 16B are section views of reflector 224 taken at different section lines. FIG. 16B is a section view taken along a line where ribs 226 extend from either side of parabolic section 224E. While the wall thickness shown in this section view may appear relatively thick, it must be noted that ribs 226 are preferably relatively thin as best shown in FIG. 16. Accordingly, any thickness added to the parabolic wall section by ribs 226 only occurs over a relatively short circumferential distance. This is in contrast to the situation where a cylindrical portion would be attached to the parabolic 224E around its entire circumference.

FIG. 16A is another section view taken along a line where ribs 226 do not extend from parabolic section 224E. As shown, there is a space between the inner surface 224BB of cylinder 224B and the outer surface of parabolic section 224E around its entire circumference except at those locations where thin ribs 226 connect them. FIG. 16A also shows how thickness is avoided by the fact that cylindrical portion 224B does not extend all the way forward (or down in FIG. 16A) to merge with parabolic section 224E.

Besides avoiding distortion issues that might be created by sink or different shrinkage rates associated with different thicknesses, reflector 224 also allows less material to be used. That is, cylindrical portion 224B preferably does not extend all the way to merge with parabolic portion 224E, and also preferably does not bridge the space between inner surface 224BB and parabolic region 224E. Accordingly, less material is needed to create reflector 224 and material cost is preferably reduced.

As with the back surface of cylindrical portion 24B of reflector 24 in FIGS. 3 and 3A, the back surface of cylinder 224B of reflector 224 includes teeth and notches 224C. Teeth and notches 224C engage corresponding teeth on spiral nut 252 in similar fashion to how reflector 24 engages spiral nut 52.

Spiral nut 252 and the manner in which it engages barrel 231 in non-rechargeable flashlight 210, and the manner in which it engages front barrel 291 in rechargeable flashlight 2100 is now further described with reference to FIGS. 17, 18, 19, 19A and 19B. A primary difference in this embodiment is that instead of the spiral groove 33 and spiral tab 52B in FIG. 1, and instead of the spiral groove 93 and spiral tab 52B in FIG. 2, spiral nut 252 includes threads 252B that engage a number of threads or starts 233, 293 on the barrels of flashlights 210, 2100.

Figure 17:
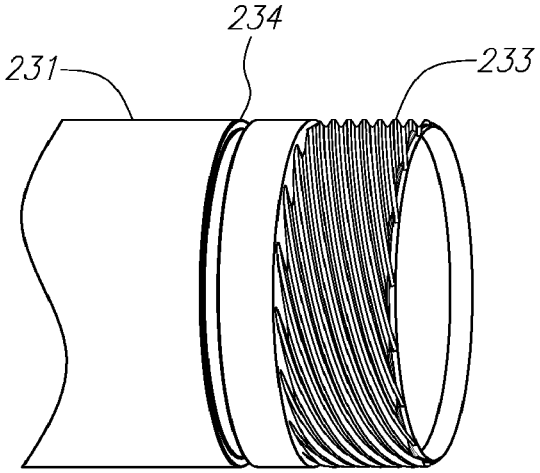
FIG. 17 is a perspective side view of a portion of a flashlight barrel.
Figure 19:
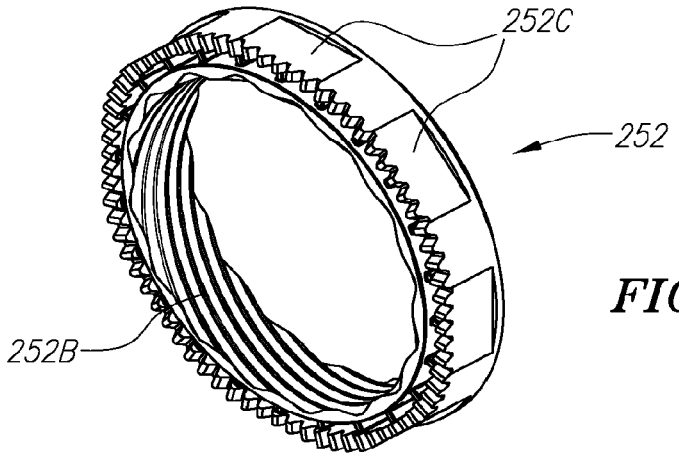
FIG. 19 is a perspective view of a spiral nut.
Figure 19A:
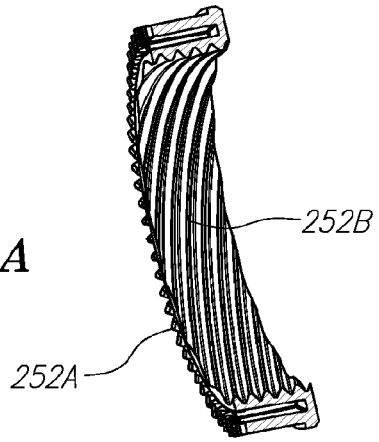
FIG. 19A is a perspective section view of a spiral nut.
Figure 19B:
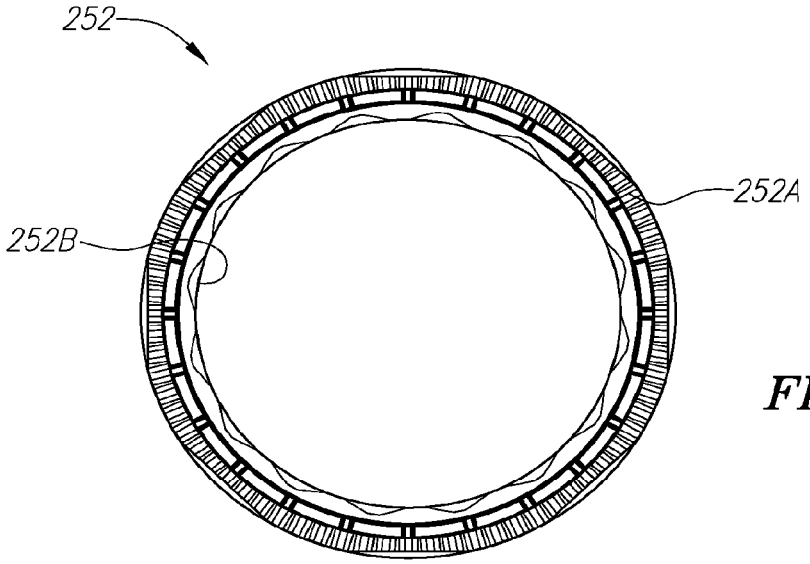
FIG. 19B is a front view of a spiral nut.

As shown in FIG. 17, the front end of barrel 231 includes threads or starts 233 and groove 234. Starts 233 on the outer surface of barrel 231 engage threads 252B on the interior surface of spiral nut 252 as shown in FIGS. 19 and 19A. In this manner, when head assembly 50 is rotated relative to barrel 231, the pitch of starts 233 and corresponding spiral nut threads 252B effect axial translation of reflector 224 relative to the stationary light source and thereby varies the focus of the light beam. That is, as head assembly 50 is rotated, the teeth 224C of reflector 224 engage teeth 252A of spiral nut 252 which in turn causes the threads 252B of spiral nut 252 to travel along the starts 233 of barrel 231.

Different numbers of starts 233 may be used, but in a preferred embodiment, sixteen starts may be used. Using a number of starts 233 provides increased stability in the axial translation of head assembly 50 in relation to barrel 231. That is, the stresses associated with rotation and axial translation of head assembly 50 are borne by multiple starts 233.

Starts 233 may be formed in barrel 231 by a rolling machining process. Starts may have a desired angle, but it is preferred that the angle be large enough so that a relatively small amount of rotation of head assembly 50 causes the desired amount of variation in focus.

Figure 18:
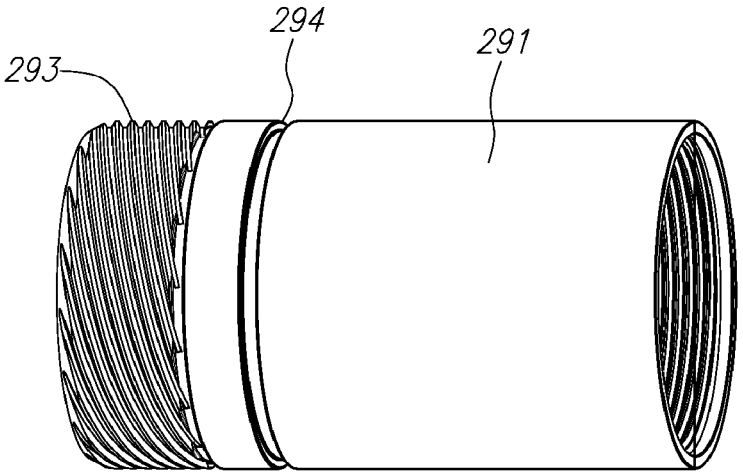
FIG. 18 is a perspective side view of a front barrel.

Referring now to FIG. 18, front barrel 291 of rechargeable flashlight 2100 may include starts 293 at its front end as well as groove 294. Starts 293 may engage the threads 252B of spiral nut 252 in the same manner as described above in connection with flashlight 210.

Another difference of the embodiments shown in FIGS. 14 and 15 is the location of the groove 234, 294 that receives snap ring 251. In these embodiments, this groove is located behind starts 233, 293 as opposed to in front of the spiral groove 33, 93 in FIGS. 1 and 2. This rearward location allows snap ring 251 to be located behind spiral nut 252 so that it does not interfere with the rotation of head assembly 50 in relation to barrel 231 or front barrel 291. Snap ring 251 may be constructed generally similar to snap ring 51 of FIGS. 1 and 2.

The feature of the current invention where the light beam may be varied and focused is now further described. As with the overall design of the lighting devices of the current invention, the feature which may vary the light beam preferably requires fewer components than existing designs. For example, the feature of varying the light beam in certain existing flashlights occurs by the reflector remaining stationary and the light source moving relative thereto. This existing design may involve an angled surface on the reflector that serves as a cam, which interacts with a cam follower that is coupled to the light source so that the light source axially translates when the head is rotated. This existing design may also involve additional components, such as a cam follower, components that attach the cam follower to the light source, a spring related to the movement of the light source and other components.

However, the design of the current invention preferably avoids the need for such additional components because the engagement between spiral tab 52B and groove 33, 93, and the engagement between teeth 24C, 52A provides for axial movement between the reflector and light source. Similarly, the engagement between spiral nut threads 252B and starts 233, 293, and the engagement between reflector teeth 224C and spiral nut teeth 252A provides for axial movement between the reflector and light source. This preferably lowers component cost and manufacturing cost because the components used to move the light source are not used. Also, the reflector 24, 224 of the current invention need not be manufactured to include an angled cam surface.

Beyond the foregoing, the design of the feature where the light beam is varied may provide other advantages. For example, because the light source is held stationary, any lack of concentricity between the light source axis and the reflector axis is not emphasized. That is, in existing flashlights where the light beam is varied by moving the light source, any lack of concentricity will be reflected in the beam of light and will be clearly seen as the light source moves relative to the reflector. This is avoided with the focusing feature of the current design.

An advantage is that the light beam may be varied more quickly. To this end, existing flashlights may require a certain amount of rotation of the head relative to the barrel to vary the light beam from spot to flood or vice versa. With the new configuration described above, the light beam may be varied with less rotation to provide the same amount of variation of the light beam. This preferably reduces wear on the component parts and also allows the user to more quickly adjust the light beam to the desired configuration.

The pitch of the spiral tab 52B and spiral groove 33, 93 may be adjusted to provide quicker or slower adjustment. To this end, it is preferred that the pitch of spiral tab 52B and spiral groove 33, 93 generally correspond and that the dimensions of the tab 52B and groove 33, 93 allow tab 52B to smoothly travel in groove 33, 39. This also applies to the pitch of spiral nut threads 252B and starts 233, 293 so that quicker or slower adjustment may occur.

In a preferred embodiment, spot to flood adjustment (or vice versa) may occur through rotating head assembly 50 relative to barrel assembly 30, 90 by about 30 degrees. However, the current invention is not limited to an adjustment involving 30 degrees of rotation and other amounts of rotation may be used, such as by about 90 degrees or by some other amount of rotation.

Beyond providing a quicker adjustment of the light beam, this feature may also reduce or avoid issues created by any lack of concentricity between the axes of the light source and reflector. That is, if the light source axis and reflector axis do not coincide, requiring a smaller angle of rotation reduces or avoids the effects of such lack of concentricity.

Another aspect of the current invention regarding heat sink 56 is now further described. As shown in FIGS. 1 and 2, heat sink 56 may hold light module 57 in a stationary position at or near the forward end of barrel 31 of flashlight 10 (FIG. 1) or at or near the forward end of front barrel 91 of flashlight 100 (FIG. 2). An embodiment of light module 57 is described in U.S. Ser. No. 12/188,201, the contents of which are incorporated by reference as if fully set forth herein. However, the configuration of the PCBs in the light module described in this incorporated application may be changed as discussed below. Furthermore, the light source used may vary as well as the manner in which light module 57 holds or positions the light source as discussed below.

Heat sink 56 may provide several functions. First, heat sink 56 may provide a mechanical function by properly aligning the light source so that its axis is in line with the reflector axis and/or axis of the centerline of flashlight 10, 210, 100, 2100. To this end, and as discussed above, light source module 57 may be press fit into heat sink 56, which may in turn be press fit into barrel 31, 231, or front barrel 91, 291. This provides benefits regarding concentricity as discussed above. This mechanical function may exist because the light source remains stationary when the beam of light is focused or otherwise varied, as opposed to the light source axially moving.

Second, heat sink 56 may also provide an electrical function in that it may form part of the ground path between light source module 57 and the negative electrode of the power source. More specifically, in the case of non-rechargeable flashlight 10, 210 of FIGS. 1 and 14, heat sink 56 may form the ground path between the negative electrode of the light source by contacting the housing of light source module 57 and a ground contact 79 of switch assembly 70 as discussed in more detail below. And in the case of the rechargeable flashlight 100, 2100 of FIGS. 2 and 15, heat sink 56 may form part of the ground path between the negative electrode of the light source by contacting the housing of light source module 57 and a ground contact 79 of switch assembly 70.

Third, heat sink 56 may also provide a thermal function by helping to dissipate heat generated by the light source. More specifically, heat sink 56 may contact the housing of light source module 57 and thus conduct heat away from light source module 57 to barrel 31, 231 or to front barrel 91, 291. Heat may then be further conducted away through barrel 31, 231 or front barrel 91, 291, or through convection to the surrounding environment. In a preferred embodiment, the light source in module 57 is an LED. Because LEDs may emit significant heat, the thermal conduction function provided by heat sink 56 is beneficial.

Another aspect of the invention relates to switch assembly 70 and the location of the electronics of flashlights 10, 100. This aspect is now described with references to FIGS. 5, 5A, 6, 6A, 7, 7A, 8 and 8A. It should be noted that though reference numeral 70 is used for the different switch assemblies of FIGS. 5, 5A, 6, 6A, 7, 7A, 8 and 8A, the switch assemblies 70 have differences as discussed below and shown in these figures. Each pair of these figures shows a non-lead frame design and a lead frame design for several different switch assemblies 70. In general, the non-lead frame switch assemblies 70 of FIGS. 5, 6, 7 and 8 may include electrical contacts that may be manually placed at certain locations in upper and/or lower housings 72, 77 of switch assembly 70 during manufacture. In the lead frame switch assemblies 70 of FIGS. 5A, 6A, 7A and 8A, these electrical contacts are preferably molded into upper and/or lower switch housings 72, 77 during manufacture. FIGS. 5, 5A, 6 and 6A generally relate to non-rechargeable flashlights 10, 210 of FIGS. 1 and 14, and FIGS. 7, 7A, 8 and 8A generally relate to rechargeable flashlights 100, 2100 of FIGS. 2 and 15.

Figure 5:
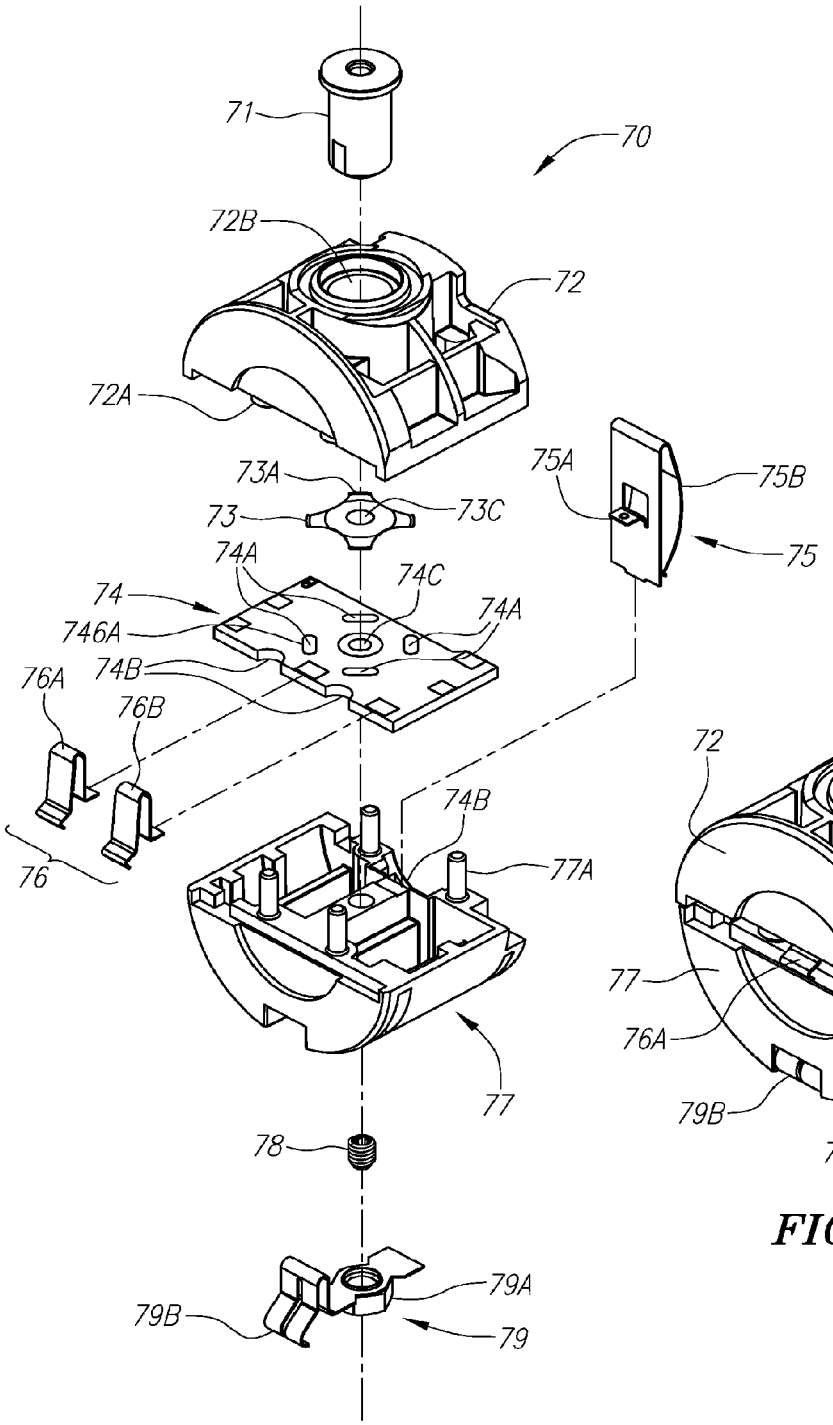
FIG. 5 is an exploded perspective view of a switch assembly.

Referring to FIG. 5, an embodiment of switch assembly 70 for a non-rechargeable flashlight 10, 210 is now further described. As shown, switch assembly 70 may include actuator 71, upper switch housing 72, snap dome 73, electronic switch PCB 74, battery contact 75, PCB contacts 76, lower switch housing 77, set screw 78 and ground contact 79.

Actuator 71 may serve as part of the user interface in that it may protrude through a hole in barrel 31 and engage a pad (or button) covering hole 32 on which the user may press. To this end, actuator 71 may travel through hole 72B formed in upper housing 72. Hole 72B may correspond to the hole in barrel 31 when switch assembly 50 is positioned within barrel 31.

When the button 32 is pressed down by the user, actuator 71 may press down on snap dome 73 which may in turn engage PCB 74. More specifically, snap dome 73 may include four ground path legs 73A which generally remain in contact with ground pads 74A on PCB 74, but when the user presses down on the button, a center contact 73C on snap dome 73 may touch center or momentary pad 74C on PCB 74 thereby closing the circuit with ground pads 74A. The manner in which the user may control the user interface by the engagement of snap dome 73 with the ground pads 74A and the engagement of center contact 73C and center or momentary pad 74C located on PCB 74 may be similar to the description in U.S. Ser. No. 12/353,965, the contents of which are incorporated by reference as if fully set forth herein.

Figure 5A:
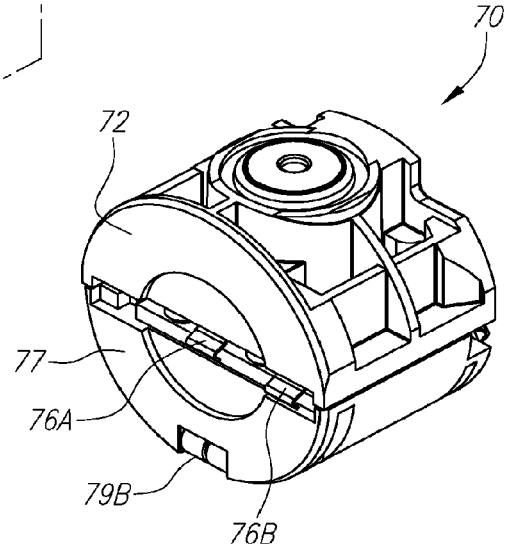
FIG. 5A is a perspective view of a switch assembly.

Upper and lower housings 72, 77 may comprise plastic and may be joined to form switch assembly 70 as shown in FIG. 5A. To this end, lower housing 77 may include posts 77A that may engage holes (not shown) in upper housing 72. Upper housing 72 may also include tabs 72A that may engage lower housing 77. Housings 72, 77 may include suitable compartments to house PCB 74, contacts 75, 76 and other desired components. PCB 74 which may include notches 74B that may correspond to front posts 77A formed in lower housing 77 and thereby secures PCB 74 within housing 70 at the desired location.

Battery contact 75 may be positioned in upper and lower housings 72, 77, and may comprise a resilient metal to form a leaf spring. Battery contact 75 may form part of the positive electrical path between the battery power source (contained within barrel 31) and PCB 74, which positive electrical path may continue to PCB 74. To this end, positive contact 75 may include a tab 75A which may electrically contact a positive pad on PCB 74, as well as a spring portion 75B which may contact the positive electrode of the battery. It is preferred that spring portion 75B be resilient so as to maintain electrical contact despite any movement of the battery within barrel 31, 231 that may occur, e.g., if flashlight 10, 210 is dropped.

Board contacts 76 are preferably positioned by housings 72, 77 to make electrical contact with corresponding pads on PCB 74. More specifically, positive board contact 76A may contact positive pad 746A, and negative board contact 76B may contact negative pad 746B. When switch assembly 70 is assembled as shown in FIG. 5A, board contacts 76A, 76B may be exposed and/or protrude by or through the forward end of switch assembly 70. And when flashlight 10, 210 is assembled, contact 76A may be positioned so as to electrically contact a positive contact on light source module 57 and its LED, while negative board contact 76B may be positioned so as to electrically contact a rear surface of heat sink 56, which in turn may electrically contact the housing of the light source module and negative electrode of the LED to form a ground path.

Ground contract 79 may also be housed by lower housing 79, and is preferably formed from a resilient metal. As shown, ground contact may include a nut portion 79A as well as a leaf spring portion 79B. When switch assembly 70 is assembled and inserted into barrel 31, 231, leaf spring portion 79B may contact a rear surface of heat sink 56, and nut portion 79A may engage the threads of set screw 78 which may be turned so that its downward point digs into the interior surface of barrel 31, 231 to continue the ground path. In this manner, ground contact 79 forms part of the ground path that extends from a ground contact of the LED in light source module 57, through the housing of the light source module, heat sink 56, ground contact 79, set screw 78, barrel 31, 231, tail cap 43, spring 41 and to the negative electrode of the power source.

Set screw 78 may also be used to position switch assembly within barrel 31, 231. The threads of set screw 78 may engage the threads of nut portion 79A of ground contact 79. That is, when switch assembly 70 is assembled and inserted into barrel 31, 231, set screw 78 may be turned so that its downward point digs into the interior surface of barrel 31, 231 thereby securing the position of switch assembly 70.

Figure 6:
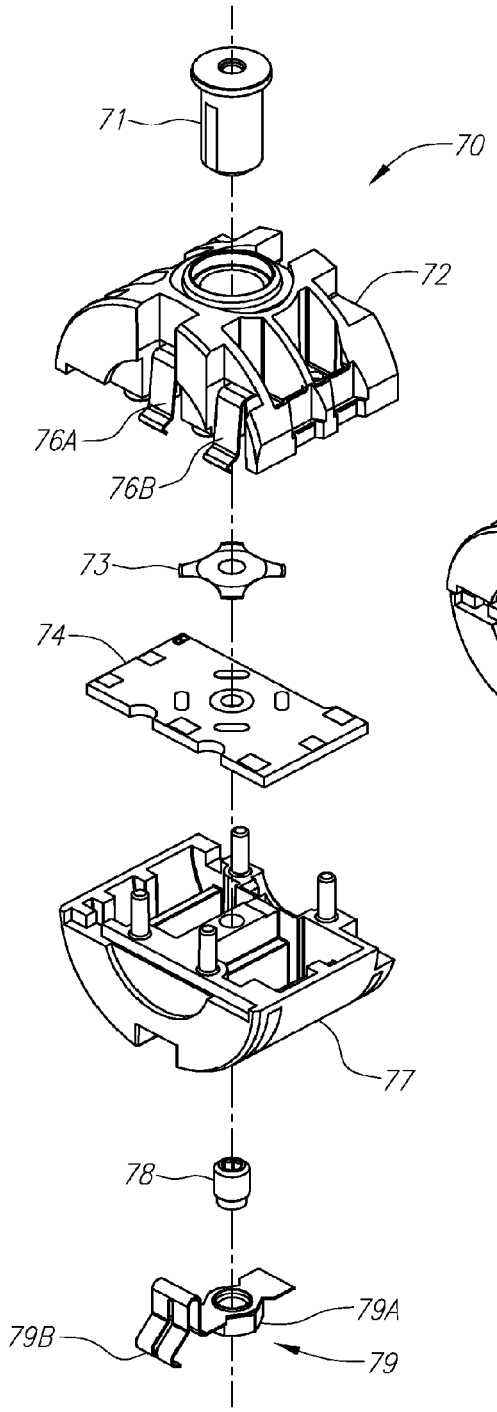
FIG. 6 is an exploded perspective view of a lead frame switch assembly.
Figure 6A:
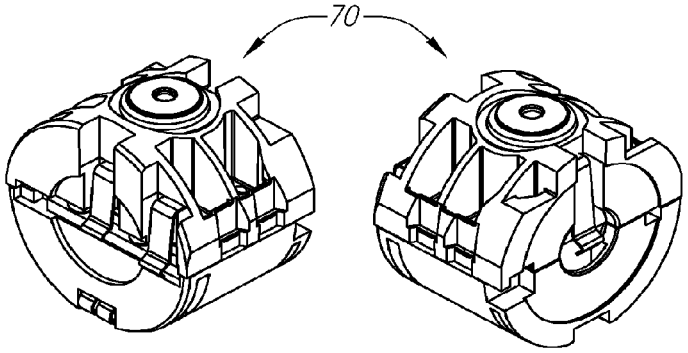
FIG. 6A is a perspective view of a lead frame switch assembly.

Referring to FIGS. 6 and 6A, a lead frame version of switch assembly 70 for non-rechargeable flashlight 10, 210 is now further described. As shown, ground contacts 76A, 76B are preferably molded into upper housing 72, as is battery contact 75 (not shown). Ground contact 79 may be molded into lower housing 77.

Figures 7, 7A:
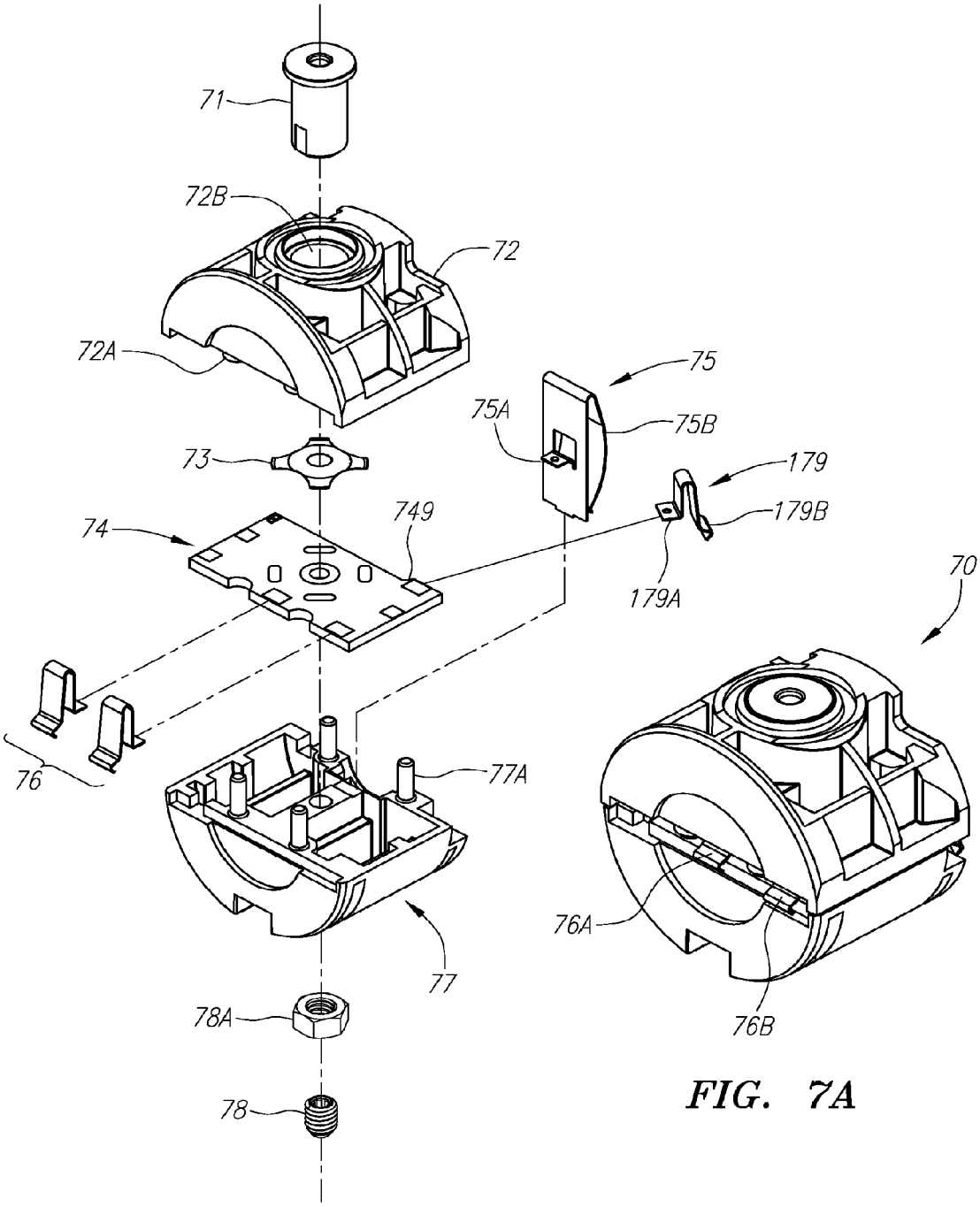
FIG. 7 is an exploded perspective view of a switch assembly.
FIG. 7A is a perspective view of a switch assembly.

Referring to FIG. 7, an embodiment of switch assembly 70 for rechargeable flashlight 100, 2100 is now further described. As shown, several of the components used in this switch assembly 70 may be similar to those shown in FIGS. 5 and 5A, but several differences may exist, such as the manner in which switch assembly 70 electrically contacts the battery power source. As mentioned earlier, when rechargeable flashlight 100, 2100 is assembled, switch assembly 70 may be positioned next to diode assembly 80.

Accordingly, one difference in switch assembly 70 of rechargeable flashlight 100, 2100 involves how contact 75 contacts the battery source of power. Leaf spring portion 75B may contact a positive contact, i.e., pin 84, of diode assembly 80, which may then contact the positive electrode of the battery power source. This may be in contrast to a direct electrical connection to the power source.

Another difference may be reflected regarding ground contact 179 that may be located at or near a rear corner of switch assembly 70. In this embodiment, ground contact 179 may include a contact portion 179A that may make electrical contact with pad 749 on PCB 74 as shown. Ground contact 179 may also include a leaf spring portion 179B that may be resilient to ensure a ground connection.

Figure 9:
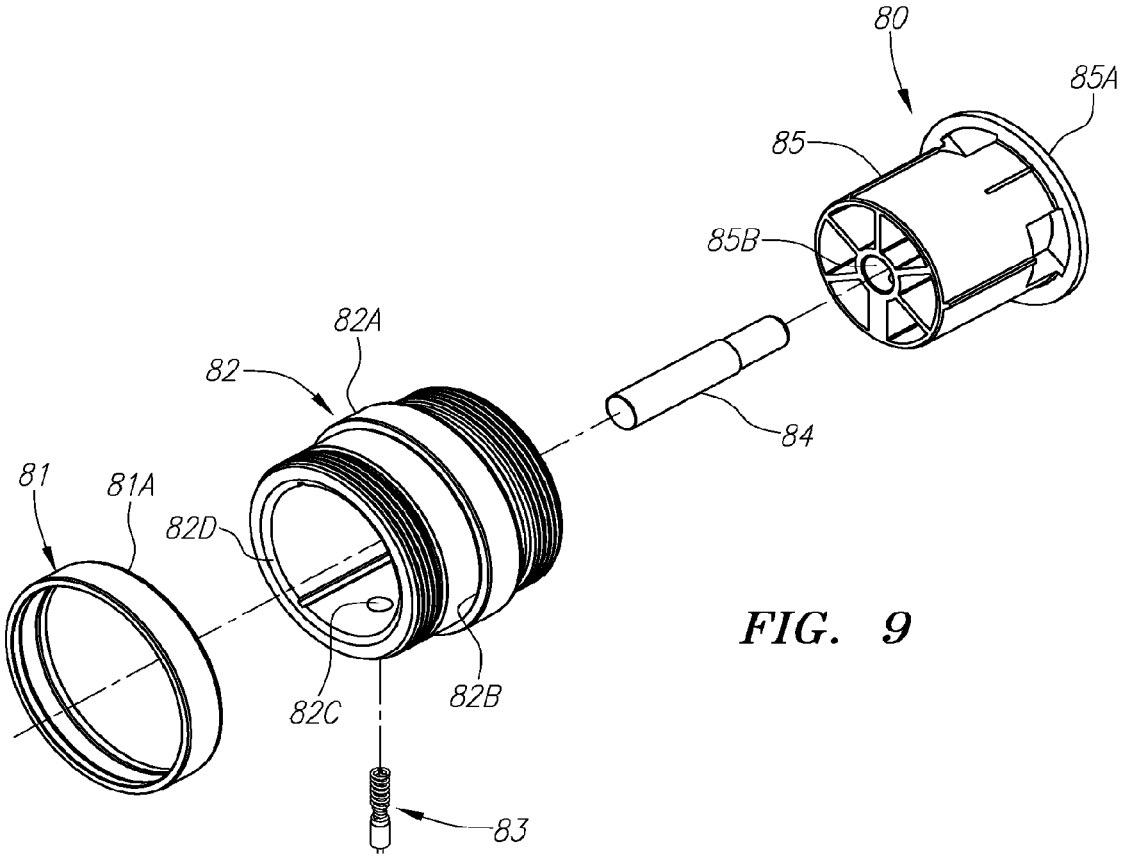
FIG. 9 is an exploded view of a diode module assembly.

As mentioned earlier, when rechargeable flashlight 100, 2100 is assembled, switch assembly 70 may be located next to diode assembly 80, and leaf spring portion 179B may electrically contact diode assembly to form a ground path. More specifically, leaf spring portion 179B may contact a front face inside chamfer surface 82D of diode housing 82 (as shown in FIG. 9). The ground path may then extend through diode housing 82 and to rear barrel 94. To this end, barrel 94 may be anodized, but may include a skin cut near its front to allow the ground path to extend from diode housing 82 to barrel 94. The ground path may then travel through barrel 94 through another skin cut near its rear end adjacent to tail cap 43, so that the ground path may continue through tail cap 43, spring 41 and ultimately to the negative electrode of the battery power source.

Figure 8:
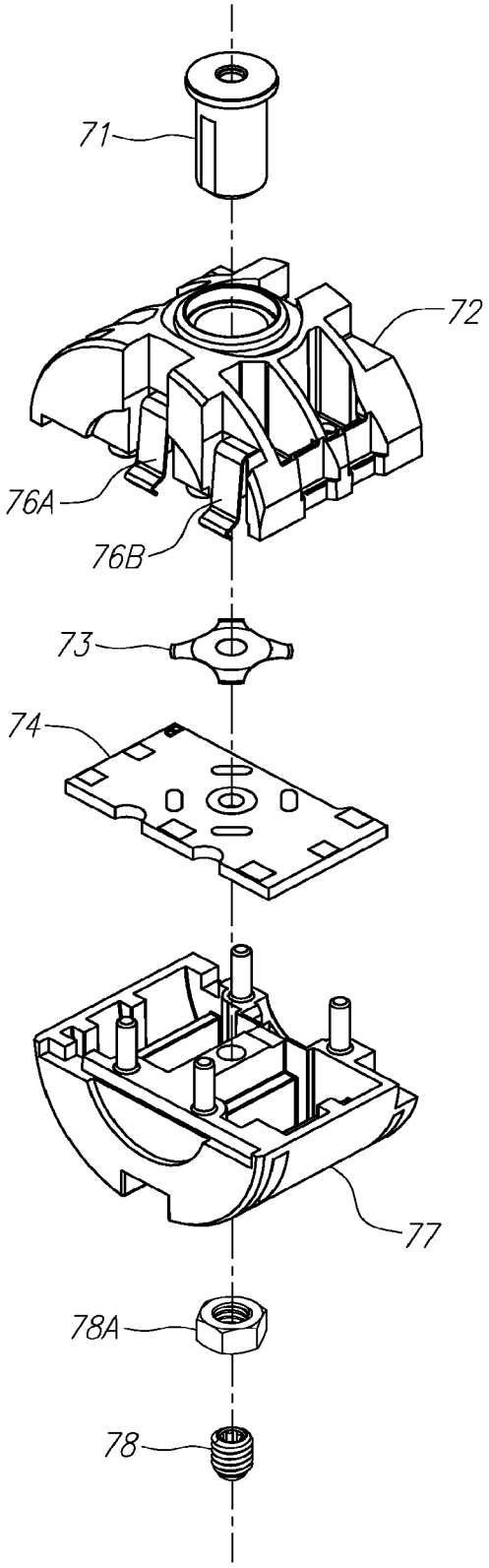
FIG. 8 is an exploded perspective view of a lead frame switch assembly.
Figure 8A:
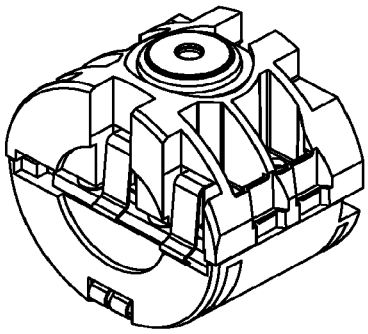
FIG. 8A is a perspective view of a lead frame switch assembly.

Referring to FIGS. 8 and 8A, a lead frame version of switch assembly 70 for rechargeable flashlight 100, 2100 is now further described. As shown, ground contacts 76A, 76B are preferably molded into upper housing 72, as is battery contact 75 (not shown). Ground contact 179 may be molded into lower housing 77.

Light source module 57 is now further described. Module 57 preferably contains an LED light source. Certain existing light source module designs include multiple PCBs, such as in U.S. Ser. No. 12/188,201 which is incorporated by reference as if fully set forth herein. In the current invention, however, the functions provided by one of these PCBs may be provided by electronic switch PCB 74 located in switch assembly 70. In order to still use the hardware and electrical paths provided by existing light modules 57, the second board therein may be replaced with a pass through board.

Other aspects of the current invention related to the manner in which rechargeable flashlight 100, 2100 may be recharged are now further described with reference to FIGS. 9 and 9A. Certain existing rechargeable flashlights include a feature on their outer surface that may electrically engage a charger. An example of this are flashlights that include dual charging rings, or commutating rings, which are located on their outer surface and which may engage electrical contacts in a charger cradle.

One example of such an existing design involves several rings that were slipped over the flashlight barrel. To this end, a first or rear commutating ring is formed by removing the anodizing from the barrel so that an electrical connection could be made between the barrel and commutating ring. This design also involves a first non-conductive insulating ring positioned forward of the rear commutating ring (etched portion). Then, a second or forward commutating ring positioned forward of the first insulating ring, and then a second insulating ring positioned forward of the front commutating ring. As known in the art, the insulating rings served to insulate the commutating rings from each other and to also insulate the second or forward commutating ring from the metal below it, i.e., the barrel.

While this existing design has worked effectively, it does involve several components and manufacturing steps to assemble the several rings. However, the design of the current invention, as shown in FIGS. 9 and 9A, preferably serves to reduce the number of components so as to lower cost and increase reliability.

Figure 9A:
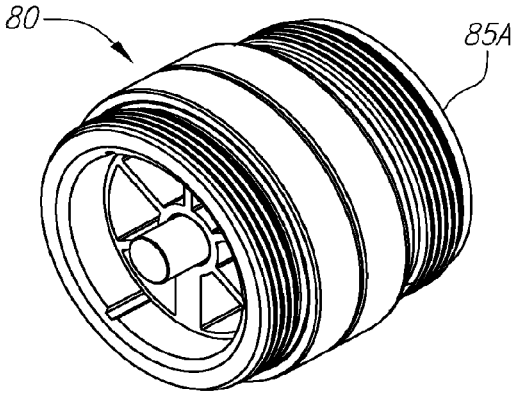
FIG. 9A is a perspective view of a diode module assembly.

FIGS. 9 and 9A show the diode assembly 80 of rechargeable flashlight 100 (as well as the diode assembly 80 of flashlight 2100). As shown, diode assembly 80 may include commutating ring 81, diode module 82, diode 83, contact pin 84 and insulator module 85. Commutating ring 81 and diode module 82 may comprise aluminum, while insulator module may comprise a non-conductive material such as plastic. Diode module 82 may include threads on its forward and rear ends which may engage internal threads of the front barrel 91, 291 and rear barrel 94 to thereby form flashlight 100, 2100. Diode module may also include an interior chamfered surface 82D that may make electrical contact with ground contact 179 of switch assembly 70.

Diode module 82 may be machined to include the rear commutating ring 82A which may have an outer diameter that general corresponds to the outer diameter of the front barrel 91, 291 and rear barrel 94. The forward outer edge of commutating ring 82A may be chamfered. Diode module 82 may also include surface 82B that may be machined into module 82 to generally form a ring. Ring 82B may serve to receive the forward commutating ring 81.

The forward commutating ring 81 may include anodizing on its surfaces, including rear surface 81A. The anodizing on ring 81 may then be removed, or skin cut, where electrical contact is necessary, e.g., the outside surface and center of the inside surface, but the surfaces which remain anodized remain insulated, i.e., where ring 81 contacts module 82 on the face edges and the outer portions of its inner diameter. The rear outer edge of ring 81 may also be chamfered. Accordingly, when front commutating ring 81 is positioned on surface 82B, the anodizing on rear surface 81A serves to insulate the forward commutating ring 81 from the rear commutating ring 82A. This insulation is also facilitated by the chamfered outer edges of the commutating rings.

Insulator module 85 may be inserted into diode module 82. Insulator module 85 may include a hole (not shown) in its bottom that corresponds to hole 82C in diode module 82, where both holes allow diode 83 to protrude therethrough. To provide concentricity between the holes of diode module 82 and insulator module 85, grooves may be formed on the interior of diode module 82 that correspond to ribs formed on the exterior of insulator module 85. Insulator module 85 may also include a rear flange 85A which serves to insulate diode module 82 and the battery power source.

Contact pin 84 may axially extend through diode module 80 as shown in FIGS. 9 and 9A. That is, pin 84 may be held in place by bore 85B so that it makes contact with the positive electrode of the battery located behind diode module 80 and the positive contact 75 of switch assembly 70 as described above.

The commutating rings are preferably positioned to correspond to charging contacts in a charging device, such as the charger cradle described in U.S. Provisional Application Ser. No. 61/751,930, the contents of which are incorporated by reference as if fully set forth herein.

Aspects of the current invention regarding the electronics of flashlights 10, 210, 100, 2100 are now further described. As shown in FIGS. 5, 6, 7 and 8, switch assembly 70 in either non-rechargeable flashlight 10, 210 or rechargeable flashlight 100, 2100 may include electronic switch PCB 74. As discussed herein, PCB 74 may provide various functions such as different modes of operation, e.g., dimming, blinking, etc. Furthermore, by locating PCB 74 in switch assembly 70, as opposed to a remote location, the flashlight 10, 210, 100, 2100 may operate in various ways since the electronics are contained within the switch assembly. For example, with this configuration, dimming and brightness of the light provided by flashlight 10, 210, 100, 2100 may occur under analog control, though dimming and brightness may still occur through pulse width modulation (PWM).

A benefit of locating the electronics on PCB 74 may be that it reduces the number of PCBs that contain various electronics. For example, certain existing flashlights having an electronic switch already contain a PCB in the switch assembly that include the ground and other contacts, and another PCB in the light source module. But with the design of the current invention, that PCB located in switch assembly 70 may also contain various other electronic components. Accordingly, the PCB in the switch assembly may serve additional purposes, thereby avoiding the need for a separate PCB containing the electronics in the light module.

Figure 10:
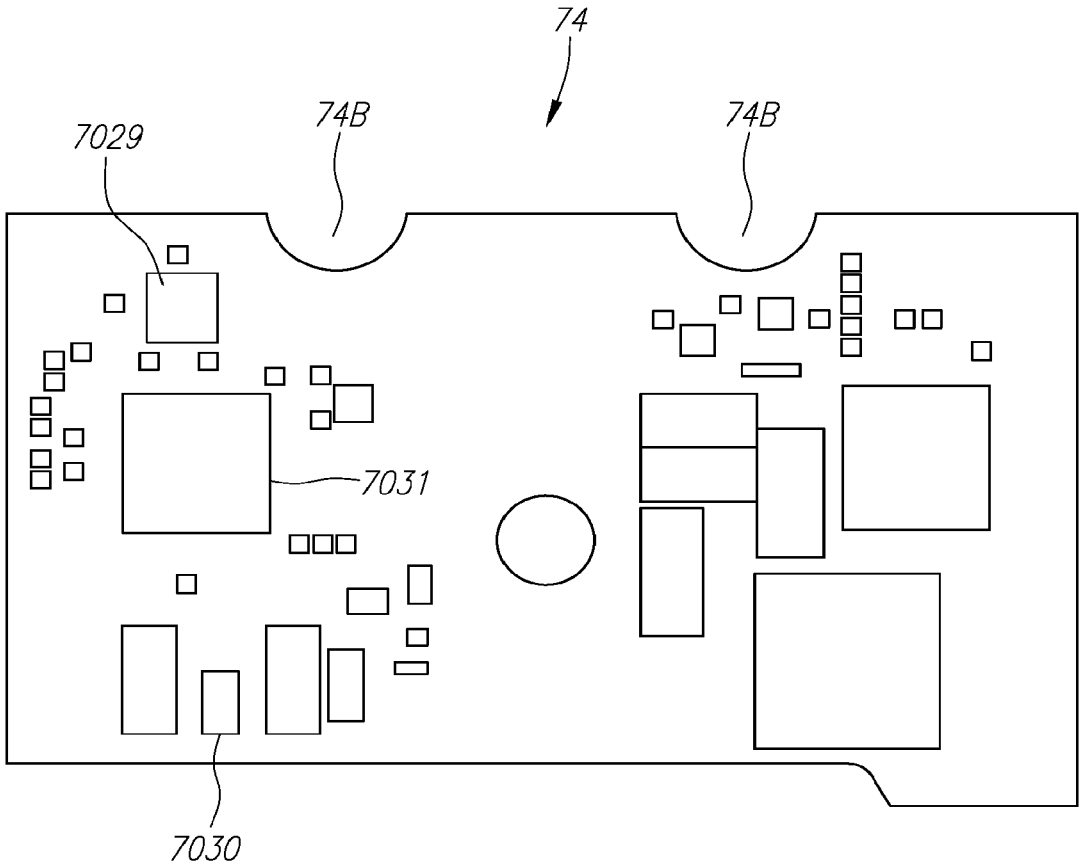
FIG. 10 is a plan view of a printed circuit board.

One side of PCB 74 may include the ground pads 74A and center pad 74C as shown in FIGS. 5, 6, 7 and 8. The other side of PCB 74 may include various components such as shown in FIG. 10. These components may include accelerometer 7029, LED driver or constant current regulator 7030 and microcontroller 7031. To this end, and as shown in FIG. 10, various suitable resistors, diodes, transistors, logic, convertors and capacitors may reside on PCB 74.

PCB 74 may also include the component(s) that allow PCB 74 to interact with the user. In FIG. 10, this is indicated by the man to machine interface 7050. In one embodiment, this interface 7050 may be represented by center pad 74C which may be located on the other side of PCB 74 and which may interact with snap dome 73 and a button that may be pressed by the user as discussed above.

Accelerometer 7029 on PCB 74 may also form part of the user interface. Accelerometer 7029 may comprise a three axis accelerometer, though other types of motion detectors may be used. Accelerometer 7029 may be used to detect how flashlight 10, 210, 100, 2100 is moved by the user and this information may be used by microcontroller 7031 to affect the how the flashlight operates. For example, rotation of the flashlight 10, 210, 100, 2100 may result in dimming of the light. The use of accelerometers to control how a flashlight operates is more fully discussed in U.S. Ser. No. 12/657,290, the contents of which are incorporated as if fully set forth herein.

Figure 11:
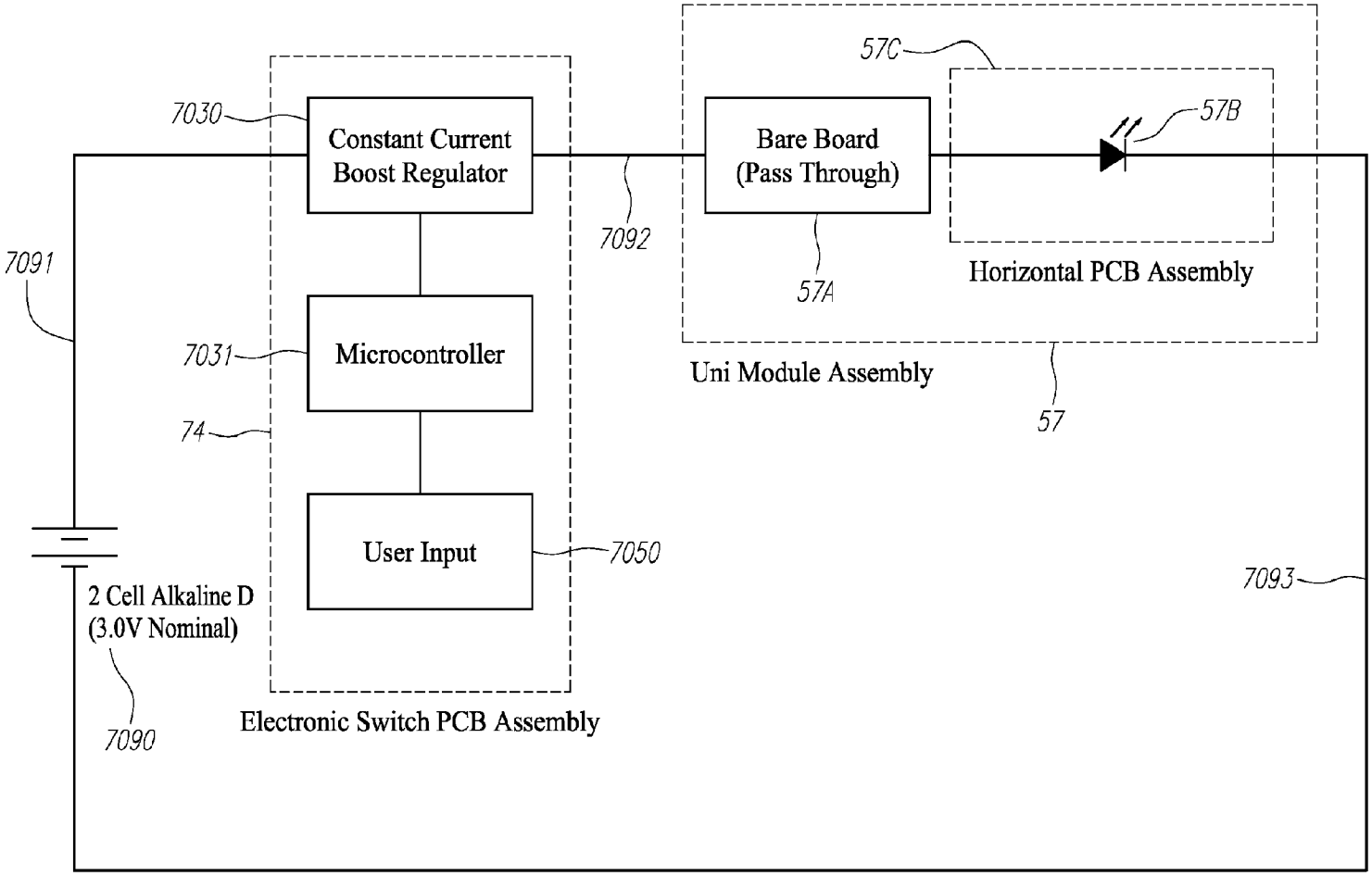
FIG. 11 is a block diagram of electronics for a flashlight.
Figure 12:
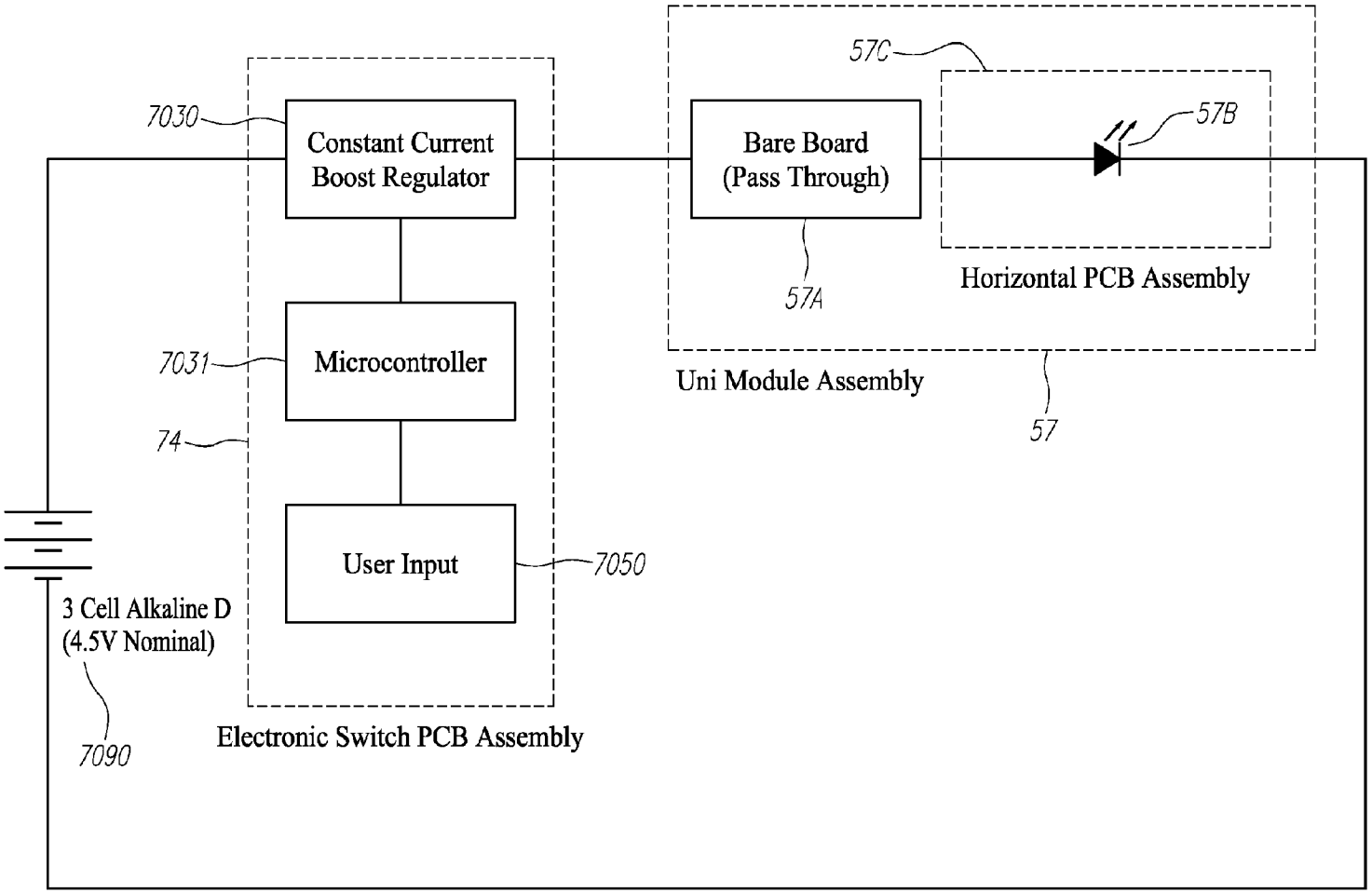
FIG. 12 is a block diagram of electronics for a flashlight.
Figure 13:
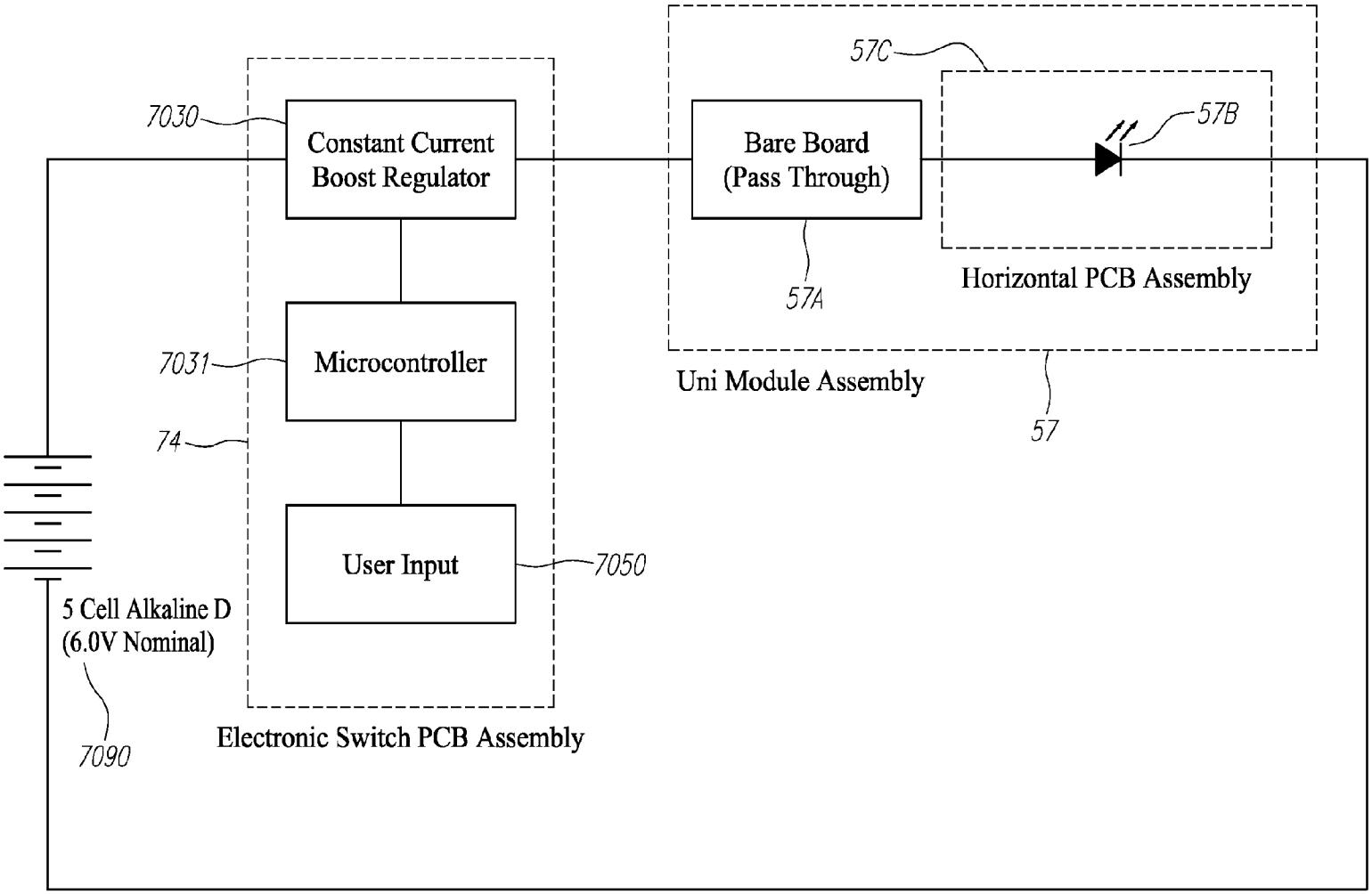
FIG. 13 is a block diagram of electronics for a flashlight.

The microcontroller 7031 on PCB 74 may receive commands from the user via user input 7050. Based on these commands, microcontroller 7031 may control the amount of current in an analog fashion that LED driver or constant current regulator 7030 outputs. In this manner, and as shown in FIGS. 11-13, the current may be generated and regulated remotely from the actual light source, e.g., LED, which is located in light source module 57.

Certain prior flashlight designs included an LED driver on a PCB in the light source module, such as light module 57, which is remote from the electronic switch itself and a microcontroller contained therein. With this design, the electronic switch contained in the flashlight would control the brightness and dimming of the LED by PWM, i.e., a switching function by making and breaking power to the input side of the LED driver. With this type of configuration, analog control could generally not be used because the current regulator was remote from the electronic switch and there was no effective electrical path over which an analog signal could be transmitted.

With the design of the current invention, however, brightness and dimming may be controlled in an analog fashion because microcontroller 7031 is in close proximity to LED driver 7030. This is advantageous since it may reduce component cost and may provide other benefits discussed below. In any event, however, brightness and dimming in flashlight 10, 210, 100, 2100 may still occur through PWM.

The electronics and their overall configurations in non-rechargeable flashlight 10, 210 and rechargeable flashlight 100, 2100 are now further described with reference to FIGS. 10-13. The switch assemblies 70 used in any of flashlights 10, 210, 100, 2100 may generally share the same or similar design topology. To this end, user interface 7050 and LED driver 7030 may be located on PCB 74. Microcontroller 7031 that resides on PCB 74 and that implements the user input as received from interface 7050, may also have control over LED driver 7030.

LED driver 7030 may generally serve as a power supply to regulate the amount of current sent to the LED or other downstream light source contained in light source module 57. Because the brightness of the LED is generally proportional to the LED current, LED driver 7030 may be used to control this parameter (i.e., LED current) to adjust or otherwise control LED brightness. When a desired current flows through the LED, a resulting voltage across the LED is formed, i.e., the forward voltage.

Because different flashlights may provide different levels of power to PCB 74 and LED driver 7030, the configuration of LED 57B may vary as discussed below in connection with FIGS. 11-13. Each of these figures shows the overall circuit of non-rechargeable flashlight 10, 210 or rechargeable flashlight 100, 2100. Moving along the electrical path, each of FIGS. 11-13 then shows the positive electrical path 7091 from the positive electrode of the battery through the components described above that form the positive electrical path to switch assembly 70 and PCB 74.

Figure 20:
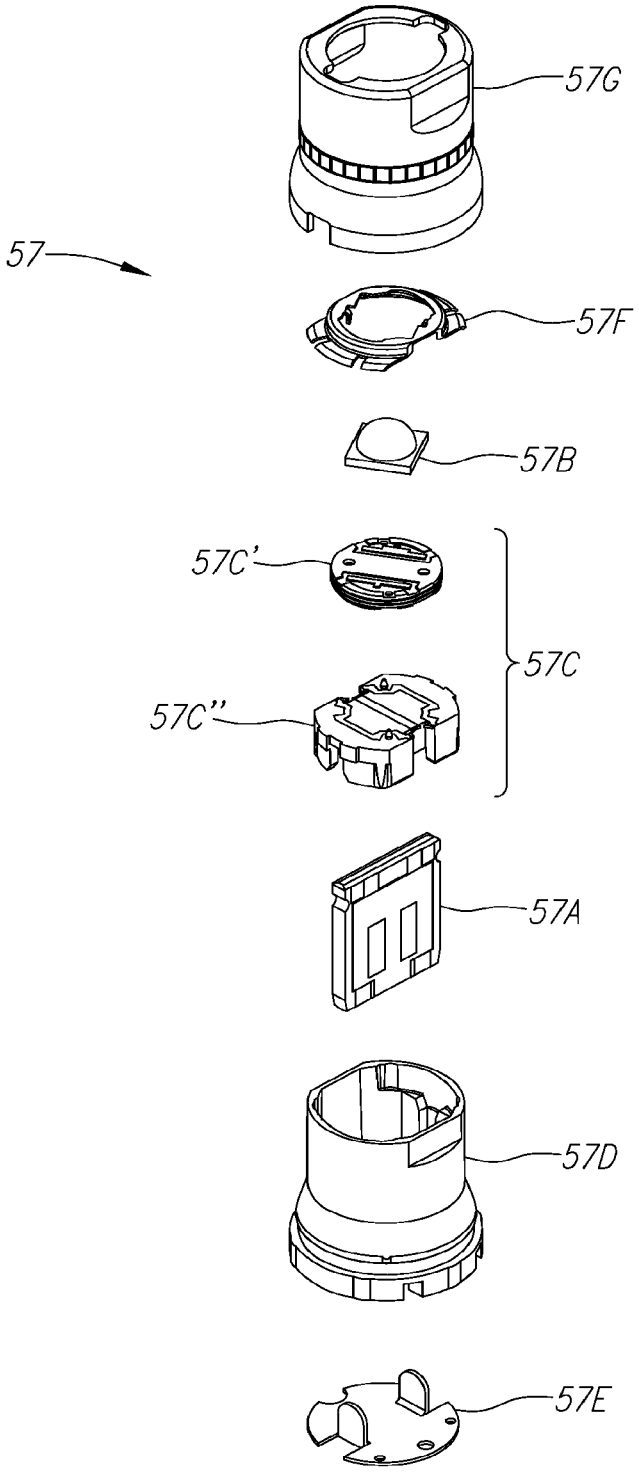
FIG. 20 is an exploded view of a light source module.

After PCB 74, each of FIGS. 11-13 shows the positive electrical path 7092 to the light source assembly 57 that may contain various components such as described in U.S. Ser. No. 12/188,201, the disclosure of which is incorporated by reference as if fully set forth herein. As shown in FIGS. 11-13, light source assembly 57 may include a pass through board 57A that may generally form an electrical path but in previous flashlights may have included electronics. In the current invention, these electronics may now reside on PCB 74. Light source module 57 may also include an LED 57B mounted on PCB assembly 57C that may include a PCB 57C' and/or insulator 57C" as shown in FIG. 20 as discussed later.

Thereafter, each of FIGS. 11-13 shows the electrical or ground path 7093 that leads back to the negative electrode of the battery power source 7090. As discussed above, this ground path may include a housing of the light source module 57, heat sink 56, contacts through switch assembly 70 and then barrel 31, 94, tail cap 43 and spring 41, to the negative electrode of the battery power source 7090.

For white LEDs, LED voltage is generally in the range of 3.0V to 3.8V. In the case where the input battery voltage is higher than the forward voltage, LED driver 7029 preferably bucks, or lowers, the input voltage as it regulates LED current. This is shown in FIGS. 12 and 13 where LED driver 7030 may comprise a constant current buck regulator 7030. In the case where the input battery voltage is lower than the forward voltage, LED driver 7030 preferably boosts, or raises, the input voltage as it regulates the LED current. This is shown in FIG. 11 where LED driver 7030 may comprise a constant current boost regulator 7030.

The number of battery cells in series may generally determine if LED driver 7030 must boost or buck the input voltage. Two battery cells in series may generally provide a nominal 3.0V when fresh. In this situation, a boosting LED driver may be used to raise the LED voltage over the life of the batteries. Three or more cells in series may generally provide a voltage that is higher than the LED voltage over most of the battery life. In this situation, a bucking LED driver may be used.

Buck LED drivers and Boost LED drivers may generally comprise switch mode power supplies and may be designed similarly to buck or boost voltage converters. Voltage converters may reside on PCB 74 and may regulate the output voltage to a certain voltage that is fed back to the converter. The converter may adjust the output as necessary to maintain this voltage over a wide power load. LED drivers may replace the voltage signal that is fed back to the voltage converter with a voltage that is proportional to the LED current. Generally a low loss resistor such as a sense resistor may be used to create a signal that is fed back to the converter and is proportional to the LED current.

The above-described LED current feedback configuration relates to electronic switch PCB 74 in that switch assembly 70 may add another signal to the LED current feedback. This signal may be generated by microcontroller 7031 and may be added to the LED current feedback signal. This preferably allows microcontroller 7031 to control the brightness of LED driver 7030 in real time.

For example, microcontroller 7031 may add a voltage between 0V and 3.3V that would put the LED current between a minimum level and a maximum level. In this example, when this signal is off, or 0V, LED driver 7030 may produce a maximum amount of LED current, and when the signal is fully on, or 3.3V, LED driver 7030 may regulate to a minimal amount of LED current. A signal in the middle, e.g., 1.65V, may result in 50% of maximum LED current. Microcontroller 7031 may drive the LED to any desired DC current level.

The LED driver 7030 of the current invention is preferably configured for minimal and maximum LED currents in view of the input signal from microcontroller 7031. When operating in this fashion, the current invention provides LED dimming in the form of analog dimming.

As indicated above, flashlights 10, 210, 100, 2100 may also regulate LED brightness through PWM. In this situation, LED driver 7030 may be configured to produce a fixed LED current. LED driver 7030 may be turned on or off with a signal from microcontroller 7031 at some fixed frequency. If microcontroller 7031 is to lower the LED current, it may decrease the duty cycle or the ratio of on/off of LED driver 7030. The frequency of this duty cycle is preferably higher than what the human eye can detect.

PWM generally produces an average LED brightness with fixed amplitude. There are advantages to PWM dimming in that there is very little color shift over the full duty cycle range as the LED die temperature saturates quickly and there is little differences in temperature as the duty cycle changes. In analog dimming, the temperature of the die will be much less at lower LED currents and some slight difference in LED beam color might be detected by the human eye.

However, analog dimming is very quiet in terms of EMI (electromagnetic interference) footprint since there is no switching on/off of the current. The on/off switching of PWM systems can produce transients with large EMI energy and harmonics of this could potentially create EMC (electromagnetic compatibility) issues.

PWM based systems can also couple visually to motors and other rotating or oscillating objects creating a safety hazard. An example is a rotating fan that the frequency of the PWM system is close to. This creates the illusion that the fan blade is not spinning. Accordingly, the use of analog dimming preferably avoids these scenarios.

An embodiment of light source module 57 is now further described with reference to FIGS. 20, 20A and 20B. As noted earlier, a light source module such as that described in U.S. Ser. No. 12/188,201, incorporated by reference herein, may be used with modifications as described herein. As shown in FIG. 20, light module may include board 57A, LED 57B and PCB assembly 57C as discussed in connection with FIGS. 11-13.

PCB 57A may generally function as a pass-through board. PCB assembly 57C may include board 57C' and insulator 57C" which may function, at least in part, similar to those corresponding components described in U.S. Ser. No. 12/188,201. Light module 57 may also include insulator 57D, contact 57E, ring 57F and housing 57G, which may also be similar to the corresponding components described in U.S. Ser. No. 12/188,201.

Figure 20A:
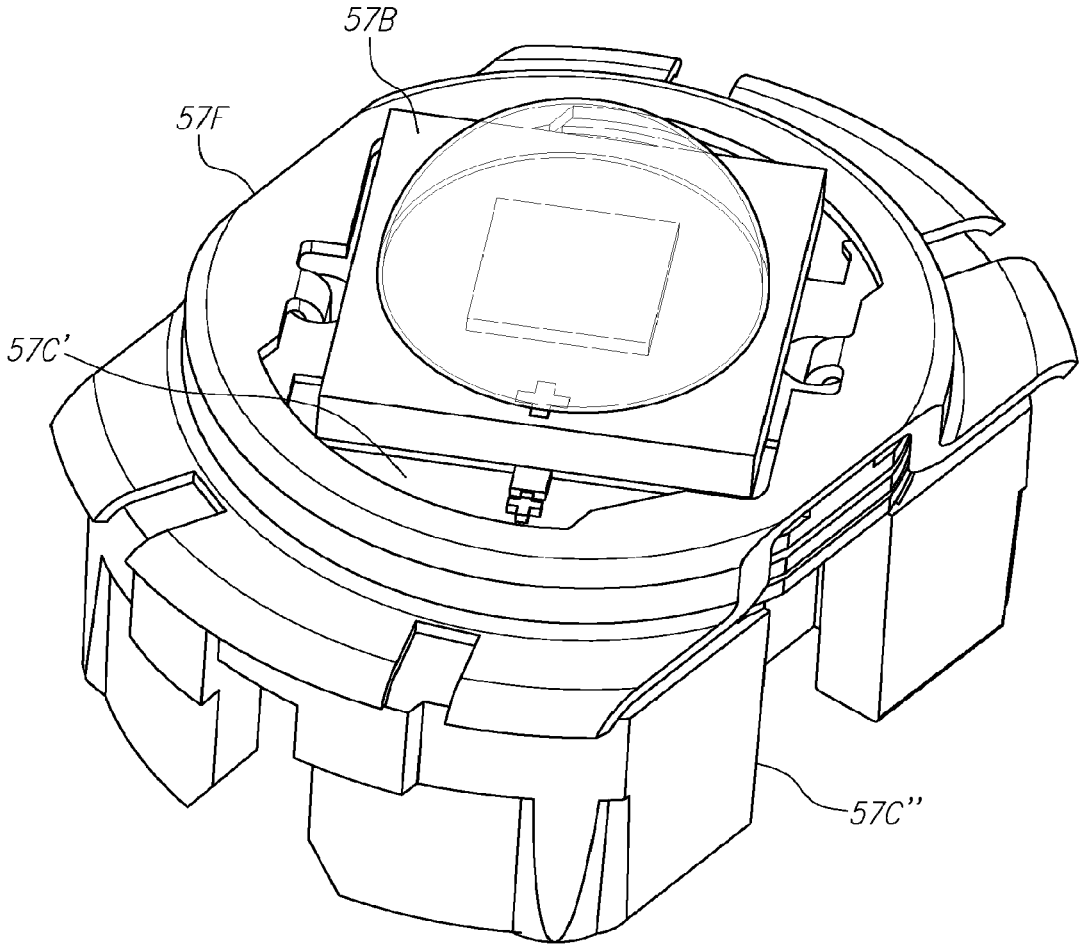
FIG. 20A is a perspective view of an assembled portion of a light source module.
Figure 20B:
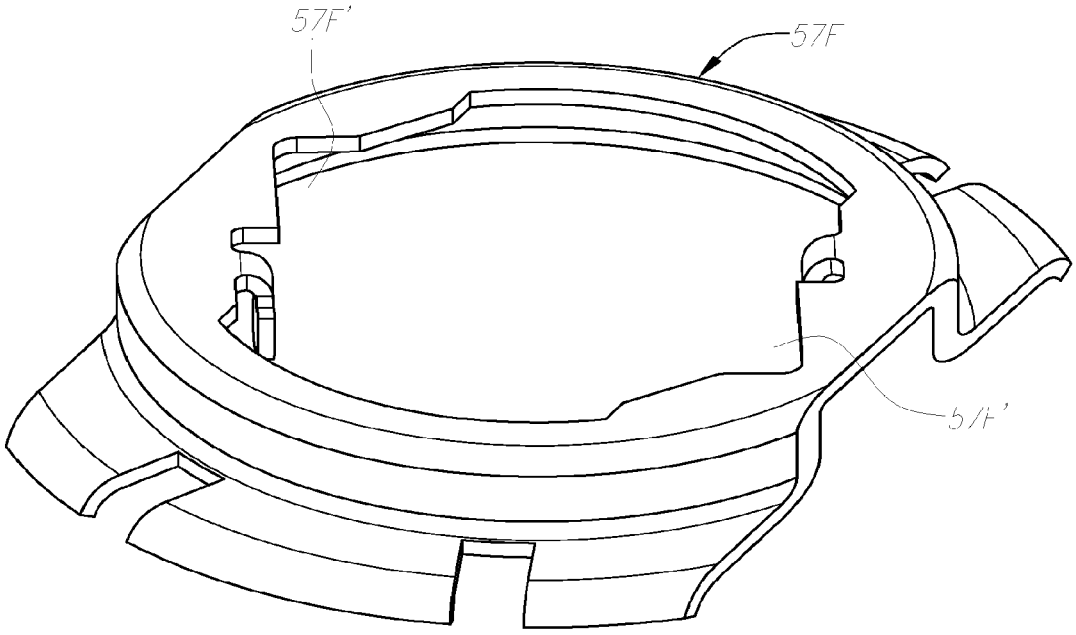
FIG. 20B is a perspective view of a thermally-conductive ring.

However, as shown in FIGS. 20A and 20B, ring 57F may include notches 57F' to accommodate the mounting of LED 57B. In this embodiment, LED 57B may be larger than LEDs used previously and/or may include a square base (or other base configured in a different shape) which may not fit within and/or on light source module 57. For example, LED 57B and board 57C' are generally mounted on insulator 57C". And the size of LED 57B may not allow it to be mounted thereon. Accordingly, the base of LED 57B may be rotated so that it may be mounted, and notches 57F' may be included in ring 57F to accommodate this.

The manner in which different modes of operation may be selected is now further described. Modes may generally be selected through the user interface 32, which may comprise a push button or other type of switch. The types of modes that may be provided by any of the lighting devices described herein may vary, but in a preferred embodiment, full power, half power, quarter power and strobe modes may be provided. However, other modes may also be provided such as SOS and momentary modes.

In a preferred embodiment, the first mode may be chosen by pressing down on the user interface once and quickly letting go, e.g., quickly clicking on button 32 once. This may turn the flashlight on and into full power mode. After turning off the flashlight, the user may then click on the button 32 and release twice to select the second mode which may be half power. Alternatively, the user may hold the button down after the second click for a predetermined amount of time to select the third mode, which may be quarter power. The predetermined time for which the button is held down on the second click may vary, but for example, may be ½ of a second. In this manner, the user may hold down the button after the second click for whatever predetermined time may be set, until he or she sees the change in mode. Alternatively, after turning off the flashlight, the user may then perform three quick clicks to select another mode.

The manner in which modes may be selected by quickly clicking on the user interface a number of times, i.e., "quick click", is discussed in U.S. Pat. No. 7,566,149 and U.S. Ser. No. 12/928,519, filed Dec. 13, 2010, both of which are incorporated by reference as if fully set forth herein. The manner in which modes may be selected by continually pressing down on the user interface for a predetermined time, i.e., the "press-hold", is discussed in U.S. Ser. No. 13/398,611, filed Feb. 16, 2012, which is incorporated by reference as if fully set forth herein. The combination of the quick click and press-hold methods to select modes is discussed in U.S. Ser. No. 13/216,092, filed Aug. 23, 2011, which is incorporated by reference as if fully set forth herein.

Another possible embodiment regarding the use of quick click and press-hold to select modes is now further described. To this end, the click frequency and press-hold duration may be timed in software by an internal oscillator of the microcontroller. This is preferred because it facilitates that mode changes are repeatable, accurate and consistent when the switch is clicked on/off in the desired pattern. Accordingly, modes may be changed as follows. Though specific modes are referenced below, one skilled in the art will appreciate that different modes may be used in different orders.

Mode 1 [Full Power Mode]—With the light OFF, switch PRESS and HOLD, or PRESS and RELEASE [any duration]—light enters Full Power Mode. Subsequent PRESS of any duration will turn light off.

Mode 2 [Half Power Mode]—With the light OFF, switch PRESS [less than a predetermined time], switch RELEASE [less than a predetermined time], switch PRESS [less than a predetermined time], switch RELEASE [less than a predetermined time]—light enters Half Power Mode. Subsequent PRESS of any duration will turn light off.

Mode 3 [Quarter Power Mode]—With the light OFF, switch PRESS [less than a predetermined time], switch RELEASE [less than a predetermined time], switch PRESS [less than a predetermined time], switch HOLD [equal to or greater than a predetermined time which may be longer than the foregoing predetermined time]—light enters Quarter Power Mode. Subsequent PRESS of any duration will turn light off.

Mode 4 [Strobe Mode]—With the light OFF, switch PRESS [less than a predetermined time], switch RELEASE [less than a predetermined time], switch PRESS [less than a predetermined time], switch RELEASE [less than a predetermined time], switch PRESS—light enters strobe mode. Subsequent PRESS of any duration will turn light off.

By way of example only, the predetermined amount of time may be 250 mS and the switch HOLD time to enter Mode 3 may be 500 mS. However, other durations may be used within the scope of the invention.

As noted above, the modes provided by the lighting devices of the current invention may vary from those identified above. Furthermore, it is preferred that the user may customize the modes to be provided. To this end, the lighting devices of the current invention may come programmed with different sets of modes, or menus, that may be chosen by the user. Once a menu is chosen, the click and press-hold sequence may vary and may be used to access different modes. It is preferred that the user may select menus, or sets of functions or modes, by a user interface which may involve, for example, the pushbutton switch described above. An example of reconfigurable menus or function sets and the manner in which they may be selected is discussed in U.S. Ser. No. 12/928,519, filed Dec. 13, 2010, which is incorporated by reference as if fully set forth herein.

In a preferred embodiment, the following function sets may be provided: (1) full power, power save, strobe; (2) full power, power save, SOS signal; (3) momentary, full power, power save; and (4) momentary, full power and strobe. Within each function set, the functions or modes may be accessed by the quick click method described above. However, the invention is not limited to those modes and function sets, since other combinations, as well as different manners in which to access the modes may be used.

The lighting devices of the current invention may also include a mode retention and/or recovery feature which may apply as follows. In the event the lighting device is dropped, the batteries may move within the device and cause loss of power to the microcontroller. In turn, the light may shut off. To address this situation, the lighting devices of the current invention may include "bounce detection" circuitry accompanied by software that may detect battery movement and loss of power, but still allow the light to recover back into the mode it was previously in. This mode retention feature is discussed in U.S. Ser. No. 13/398,611, filed Feb. 16, 2012, which is incorporated by reference as if fully set forth herein. As an alternative, it may be preferred that certain modes may change when recovered, e.g., in the example discussed above, mode 3 may revert to mode 2 when recovered.

Improvements to the embodiments already described can be achieved by a combination with other inventions. For example, while the present application, so far, has described use of a light source module 57, such as that described in U.S. Ser. No. 12/188,201, which can be held in a stationary position by a heat sink 56 at or near the forward end of the barrel of a flashlight using a non-rechargeable or a rechargeable power source, such flashlights can be improved by using the inventions set forth in U.S. Ser. No. 14/971,971, in which an LED, rather than a light source module, is mounted to a top surface of a heat sink. Moreover, the heat sink may be modified as described in U.S. Ser. No. 14/971,971, which will now be discussed.

As disclosed in U.S. Ser. No. 14/971,971, the interior of the heatsink, or core, is an electrical insulating material that positions and electrically isolates a second electrically conductive member that extends out the end opposite from the LED to provide an electrical connection point. The top surface of this assembly provides a mounting surface for the LED. The anode or cathode side of the LED, and in some cases a dedicated thermal pad, is bonded to the top surface of the heatsink by soldering or some other thermally and electrically conductive method or material. The electrically opposite side of the LED package is bonded to the isolated second member. Power from an appropriate electrical circuit is applied to the heatsink and the isolated terminal to turn on the LED. Heat generated by the LED is conducted through the interface with the heatsink to ambient air. The LED runs much cooler and efficiently in this system than is possible with those mounted on printed circuit boards. FIGS. 21A through 31 depict variations on the design described above. As shown, the heatsink can be different shapes depending on the application. A heatsink can also support multiple LEDs in a variety of configurations; a circular array and a linear array are only two of many possibilities. Electronics with a suitable interconnect method can also be suspended in the insulating core. It is also possible in all cases to provide electrically insulating material that positions and electrically isolates two electrically conductive members that extend out the end opposite from the LED to provide electrical connection points. In these cases the cathode and anode LED pads are bonded to corresponding isolated pads and the LED thermal pad is bonded to the invention's heatsink surface.

The improved heatsink method depicted in FIGS. 21A through 31 does not utilize a PC board for mounting the LED; instead, the LED is mounted directly to the metal surface of the heatsink. This method produces much improved heat transfer and a cooler operating, higher lumens LED, compared to PC board mounted LED designs.

The invention disclosed in Ser. No. 14/971,971 provides a direct efficient path to conduct heat away from an LED to ambient air outside of a flashlight or any other lighting device such as a headlamp, lantern or spotlight, as well as all types of area lighting that utilize high powered LEDs as a light source. Other heatsinking methods produce thermal paths that are interrupted by a large number of thermal junctions, some of which have poor thermal conductivity or high thermal resistance. Examples of prior art heatsinking methods are illustrated in FIGS. 32A through 33D. Unique to the present invention is the ability to solder the terminal and heatsink directly to the electrical and thermal pads of the LED. No thermal grease or adhesives are required. In other designs the equivalent heatsinking and electrical contact pads are on a PC board which results in more, less efficient, thermal junctions and longer, smaller cross section, thermal paths to ambient air. The use of thermal grease and adhesives in these less efficient designs helps heat transfer to some degree but not to the level of attaching the LED directly to the heatsink. The result of the much improved heat transfer possible with the invention is that the LED operates much cooler and therefore much more efficiently. Higher lumens are possible with no increase in power over conventional systems. It is also possible to maintain lumens at the same level as other less efficient systems but consume far less power. This is especially important in battery powered lighting systems as on-time is extended without reducing lumens. The superior performance of the present invention is demonstrated by the lumens output 60 seconds after applying a constant 4 amps of current to the LED. The invention was better than other systems as follows:

The invention of Ser. No. 14/971,971 (FIGS. 2A-D) produced 19 percent more lumens than the system in FIGS. 33A-D (typical star, metal backed PC board mounted LED); and The invention of Ser. No. 14/971,971 (FIGS. 22A-D) produced 93 percent more lumens than the system in FIGS. 32A-D (multi-layer conventional PC board with extra copper traces and vias to attempt to conduct heat away from the LED).

It is worth noting that the efficiency of the invention of Ser. No. 14/971,971 can be increased or optimized, with the aid of the present disclosure, by increasing or maximizing the surface area exposure between the heatsink and the thermally and electrically conductive outer casing while also designing the heatsink to have a sufficient mass to effectively and efficiently conduct heat between the heatsink and the outer casing. Thus, for example, heatsink 2 in FIGS. 22A-D will have better results than heatsink 2 of FIGS. 21A-D, while FIGS. 23A-D illustrate an embodiment in which the heatsink is integrally formed with the outer casing, which should result in better results than the heatsink of FIGS. 22A-D.

It is also worth noting that the outer casing, which is illustrated in the exemplary embodiments depicted in FIGS. 21-31 as a tube or barrel, need not be thermally and electrically conductive over its entire outer surface, although an outer casing which is thermally and electrically conductive over its entire outer surface may achieve better results.

It is further worth noting that the advantages obtained by the more efficient cooling of one or more LEDs obtained by the invention of Ser. No. 14/971,971 can be used to create a flashlight mode use of increased lumens, or a flashlight mode with increased on-time, or one or more modes that alternate between such modes or combine elements of both such modes.

The invention of Ser. No. 14/971,971 lends itself to a more efficient, less costly, lighting device that can be manufactured economically through automation. In illustrative embodiments shown in FIGS. 39C-D and 40A-B, a heat sink assembly 200 is created by soldering two electrically conductive members of an LED 5 to a top surface of heatsink 2. Commercially available LEDs typically have three pads (see, e.g., FIG. 31D where second electrical connection 7 has one rectangular pad while thermal junction and first electrical connection between LED 5 and heatsink 2 have two rectangular pads) which can all be used for soldering (solder S1 in FIG. 39A is for one pad whereas solder S2 in FIG. 39A is for two pads). After heat sink assembly 200 is created, it can be press fit into a tube or barrel 1 as illustrated in FIGS. 39C and 39D or it can be removably inserted into tube or barrel 1 and then held in place by a removable holding mechanism, an example of which is nut 1B illustrated in FIGS. 40A and 40B. In the embodiments illustrated in FIGS. 40A and 40B, in an especially preferred embodiment, tube or barrel 1 and heat sink 2 are made of aluminum, heat sink 2 is coated with a metallic plating (e.g., nickel) that helps promote the soldering process, and a skin cut is made of the aluminum where heat sink 2 comes into contact with a top surface 1AT of shoulder 1A formed in tube or barrel 1 (so as to promote more efficient thermal heat transfer).

Another example of how other inventions can be combined with the present embodiments already disclosed to create further improvements is to incorporate the inventions of U.S. Ser. Nos. 14/869,628 and 14/869,962 into the embodiments already disclosed. Thus, for example, for a flashlight with a non-rechargeable battery source, especially with three or more battery cells, shock absorbing spacers and a terminal end shock absorber can be employed while, for a flashlight with a rechargeable battery source (bundled together as a stick), a two piece tail cap, such as disclosed in FIGS. 33 and 34 of said applications, can be employed.

While the invention has been described herein with reference to certain preferred embodiments, those embodiments have been presented by way of example only, and not to limit the scope of the invention. Additional embodiments thereof will be obvious to those skilled in the art having the benefit of this detailed description.

Accordingly, it will be apparent to those skilled in the art that still further changes and modifications in the actual concepts described herein can readily be made without departing from the spirit and scope of the disclosed inventions.

What is claimed is:

1. A flashlight, comprising:

a housing which is thermally and electrically conductive having a first mechanical spiral engagement system;

a head assembly that includes a second mechanical spiral engagement system that engages the first mechanical spiral engagement system when the head assembly is coupled to the housing;

a light emitting diode ("LED") having a first and a second electrically conductive member;

a thermally and electrically conductive heatsink having a top surface, said heatsink being held within and in thermal and electrical contact with the housing;

an electrical insulating material held within the heatsink;

a power source held within the housing; and a switch assembly;

wherein the light provided by the LED may be varied by rotating the head assembly relative to the housing while the heat sink, the switch assembly and the power source remain stationary;

wherein the LED is mounted to the top surface with the first electrically conductive member thermally and electrically directly connected to the heatsink without the use of a printed circuit board and the second electrically conductive member is electrically isolated from the heatsink by the electrical insulating material; and wherein the LED is turned on when power from an electrical circuit is applied to the heatsink and the second electrically conductive member.

2. The flashlight of claim 1, wherein the housing is a barrel and the heat sink is press fit into a forward portion of the barrel.

3. The flashlight of claim 1, wherein the housing is a barrel and the heat sink is removably secured with the flashlight barrel by a mechanical means.

4. The flashlight of claim 1, wherein the first mechanical spiral engagement system is a first set of threads and the second mechanical spiral engagement system is a second set of threads.

5. A flashlight, comprising:

a housing having a set of threads;

a head assembly including a spiral nut that includes another set of threads that engage the set of threads when the head assembly is coupled to the housing;

an LED fixedly mounted to a top surface of a heat sink fixedly held by the housing;

a switch assembly; and a power source;

wherein the heat sink, the switch assembly and the power source are part of an electrical circuit when the LED light source module emits light;

wherein the light provided by the LED may be varied by rotating the head assembly relative to the housing while the heat sink, the switch assembly and the power source remain stationary;

wherein the LED is mounted to the top surface with a first electrically conductive member thermally and electrically directly connected to the heatsink without the use of a printed circuit board and a second electrically conductive member is electrically isolated from the heatsink by an electrical insulating material; and wherein the LED is turned on when power from the electrical circuit is applied to the heatsink and the second electrically conductive member.

* * * * *